US006293421B1

(12) United States Patent
Jentzsch et al.

(10) Patent No.: US 6,293,421 B1
(45) Date of Patent: Sep. 25, 2001

(54) BEVERAGE CONTAINER WITH INCREASED BOTTOM STRENGTH

(75) Inventors: K. Reed Jentzsch, Arvada, CO (US); Otis H. Willoughby, Castle Valley, UT (US); Gary A. Baldwin, Mead, WA (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/591,206

(22) Filed: Jun. 9, 2000

Related U.S. Application Data

(63) Continuation of application No. 08/958,901, filed on Oct. 28, 1997, now Pat. No. 6,098,832, which is a continuation of application No. 08/298,351, filed on Aug. 29, 1994, now Pat. No. 5,836,473, which is a continuation of application No. 08/031,059, filed on Mar. 2, 1993, now abandoned, which is a continuation of application No. 07/600,942, filed on Oct. 22, 1990, now abandoned, which is a continuation-in-part of application No. 07/505,618, filed on Apr. 6, 1990, now abandoned.

(51) Int. Cl.[7] ..... B65D 7/00

(52) U.S. Cl. ..... 220/606; 220/604; 220/906

(58) Field of Search ..... 220/604, 606, 220/608, 609, 623, 624, 906

(56) References Cited

U.S. PATENT DOCUMENTS 4,885,924 * 12/1989 Claydon et al. ..... 72/109
6,077,554 * 6/2000 Wiemann et al. ..... 220/606 X
6,098,832 * 8/2000 Jentzsch et al. ..... 220/606 X

* cited by examiner

*Primary Examiner*—Steven Pollard
(74) *Attorney, Agent, or Firm*—Sheridan Ross P.C.

(57) ABSTRACT

A beverage container with increased strength includes a generally cylindrical sidewall that is disposed around a vertical axis, and a bottom. The bottom provides a supporting surface and includes a bottom recess portion that is disposed radially inwardly of the supporting surface. The bottom recess portion includes a concave domed panel that is disposed a positional distance above the supporting surface by a dome positioning portion of this bottom recess portion. The domed panel includes a portion thereof with a curvature in the range wherein increases in the curvature decrease the static dome reversal pressure; and the dome positioning portion includes first and second parts thereof that are disposed at different radial distances from the vertical axis and that provide increases in both roll-out resistance and static dome reversal pressure. In various embodiments the first and second parts are circumferential, arcuate, at longitudinal; and, in at least some embodiments an increase in cumulative drop height is achieved as well as increases in both roll-out resistance and static dome reversal pressure.

6 Claims, 11 Drawing Sheets

BEVERAGE CONTAINER WITH INCREASED BOTTOM STRENGTH

This application is a continuation of Ser. No. 08/958,901 filed Oct. 28, 1997 now U.S. Pat. No. 6,098,832, which is a continuation of Ser. No. 08/298,351, filed Aug. 29, 1994 now U.S. Pat. No. 5,836,473 which is a continuation of Ser. No. 08/031,059 filed Mar. 2, 1993, now abandoned, which is a continuation of Ser. No. 07/600,942, filed Oct. 22, 1990, now abandoned, which is a continuation-in-part of Ser. No. 07/505,618, filed Apr. 6, 1990, now abandoned, all incorporated herein by reference.

BACKGROUND OF THE INVENTION

This patent application is a Continuation-in-Part of U.S. patent application No. 07/606,618, filed Apr. 6, 1990.

FIELD OF THE INVENTION

The present invention relates generally to metal container bodies of the type having a seamless sidewall and a bottom formed integrally therewith. More particularly, the present invention relates to a bottom contour that provides increased dome reversal pressure, that provides greater resistance to damage when dropped, and that minimizes or prevents growth in the height of a container in which the beverage is subjected to pasteurizing temperatures and/or extreme temperatures encountered in shipping and storage.

DESCRIPTION OF THE RELATED ART

There have been numerous container configurations of two-piece containers, the is, containers having a body that has an integral bottom wall at one end, and an opposite end that is configured to have a closure secured thereto. Container manufactures package beverages of various types in these containers formed of either steel or aluminum alloys.

In the production of these containers, it is important that the body wall and bottom wall of the container be as thin as possible so that the container can be sold at a competitive price. Much work has been done on thinking the body wall.

Aside from seeking thin body wall structures, various bottom wall configurations have been investigated. As early attempt in seeking sufficient strength of the bottom wall was in form the same into a spherical dome configuration. This general configuration is shown in Dunn et al., U.S. Pat. No. 3,760,751, issued Sep. 25, 1979. The bottom wall is thereby provided with an inwardly concave dome or bottom recess portion which includes a large portion of the area of the bottom wall of the container. This domed configuration provides increased strength and resists deformation of the bottom wall under increased internal pressure of the container with little change in the overall geometry of the bottom wall throughout the pressure range for which the container is designed.

The prior art that teaches domed bottoms also includes P. G. Stephan, U.S. Pat. No. 3,349,956, issued Oct. 31, 1967; Knousel et al., U.S. Pat. No. 3,693,828, issued Sep. 26, 1972; Dunn et al., U.S. Pat. No. 3,730,383, issued May 1, 1973; Toukmanian, U.S. Pat. No. 3,904,069, issued Sep. 9, 1976; Lyu et a., U.S. Pat. No. 3,942,673, issued Mar. 9, 1976; Miller et al., U.S. Pat. No. 4,294,373, issued Oct. 13, 1981; McMillin, U.S. Pat. No. 4,804,266, issued May 30, 1989; Pulciani et al., U.S. Pat. No. 4,685,582, issued Aug. 11, 1987, and Pulciani, et al., U.S. Pat. No. 4,768,672, issued Sep. 8, 1988, and Kawamoto et al., issued Apr. 24, 1990.

Patents which teach apparatus for forming containers with inwardly domed bottoms and/or which teach containers having inwardly domed bottoms, include Maeder et al., U.S. Pat. No. 4,289,014, issued Sep. 16, 1981; Gombas, U.S. Pat. No. 4,341,321, issued Jul. 27, 1982; Elert et al., U.S. Pat. No. 4,372,143, issued Feb. 8, 1983; and Pulciani et al., U.S. Pat. No. 4,620,434, issued Nov. 4, 1980.

Of the above-mentioned patents, Lyu et al., and Kawamoto et al., teach inwardly domed bottoms in which the shape of the inwardly domed bottom is ellipsoidal.

Stephan in U.S. Pat. No. 3,349,956, teaches using a reduced diameter annular supporting portion with an inwardly domed bottom disposed intermediate of the reduced diameter annular supporting pressure. Stephan also teaches stacking of the reduced diameter annular supporting portion inside the double-seamed top of another container.

Kneusei et al., in U.S. Pat. No. 3,693,828, teach a steel container having a bottom portion which is frustoconically shaped to provide a reduced diameter annular supporting portion, and having an internally domed bottom that is disposed radially inwardly of the annular supporting portion. Various contours of the bottom are adjusted to provide more uniform coating of the interior bottom surface, including a reduced radius of the domed bottom.

Pulciani et al., in U.S. Pat. Nos. 4,685,582 and 4,768,672, instead of the frustoconical portion of Kneusel et al., teach a transition portion between the cylindrically shaped body of the container and the reduced diameter annular supporting portion that includes a first annular arcuate portion that is convex with respect to the outside diameter of the container and a second annular arcuate portion that is convex with respect to the outside diameter of the container.

McMillin, in U.S. Pat. No. 4,834,256, teaches a transitional portion between the cylindrically shaped body of the container and the reduced diameter annular supporting portion that is contoured to provide stable stacking for container having a double-sensed top which is generally the same diameter as the cylindrical body, as well as providing stable stacking for containers having a double-seamed top that is smaller that the cylindrical body. In this design, containers with reduced diameter tops stack inside the reduced diameter annular supporting portion; and containers with larger tops stack against this specially contoured transitional portion.

Supik, in U.S. Pat. No. 4,732,292, issued Mar. 22, 1988, teaches making indentions in the bottom of a container that extend upwardly from the bottom. Various configurations of these indentations are shown. The indentations are said to increase the flexibility of the bottom and thereby prevent cracking of interior coatings when the containers are subjected to internal fluid pressures.

In U.S. Pat. No. 4,885,924, issued Dec. 12, 1989, which was disclosed in W.I.P.O. International Publication No. WO 83/02577 of Aug. 4, 1983, Claydon et al. teach apparatus for rolling the outer surface of the annular supporting portion radially inward, thereby reducing the radii of the annular supporting portion. This rolling of the annular supporting portion inwardly to prevent inversion of the dome when the container is subjected to internal fluid pressures.

Various of the prior art patents, including Pulciani et al., U.S. Pat. No. 4,620,434, teach contours which are designed to increase the pressure at which fluid inside the container reverses the dome at the bottom of the container. This pressure is called the static dome reversal pressure. In this patent, the contour of the transitional portion is given such great emphasis that the radius of the domed panel, through generally specified within a range, is not specified for the preferred embodiment.

However, it has been known that maximum values of static dome reversal pressure are achieved by increasing the curvature of the dome to an optimum value, and that further increases in the dome curvature result in decreases in static come reversal pressures.

As mentioned earlier, one of the problems is obtaining a maximum dome reversal pressure for a given metal thickness. However, another problem is obtaining resistance to damage when a filled container is dropped onto a hard surface.

Present industry testing for drop resistance is called the cumulative drop height. In this test, a filled container is dropped onto a steel plate from heights beginning at three inches and increasing by three inches for each successive drop. The drop height resistance is then the sum of all the distances at which the container is dropped, including the height at which the dome is reversed, or partially reversed. That is, the drop height resistance is the cumulative height at which the bottom contour is damaged sufficiently is preclude standing firmly upright on a flat surface.

In the U.S. patent application No. 07/606,618 of which this present application is a Continuation-in-Part, it was shown that decreasing the dome radius of the container increases the cumulative drop height resistance and decreases the dome reversal pressure. Further, it was shown in this prior application that increasing the height of the inner wall increases the dome reversal pressure.

However, as the dome radius is decreased for a given dome height, the inner wall decreases in height. Therefore, for a given dome height, an increase in cumulate drop resistance, as achieved by a decrease in dome radius, results in a decrease in the height of the inner wall together with an attendant decrease in the dome reversal pressure.

Thus, one way to achieve a good combination of cumulative drop height and dome reversal pressure, is to increase the dome height, thereby allowing a reduction in dome radius while leaving an adequate wall height. However, there are limits is which the dome height can be increased while still maintaining standard diameter, height, and volume specifications.

An additional problem in beverage container design and manufacturing has been in maintaining containers within specifications, subsequent to a pasteurizing process, then filled beverage containers are stored at high ambient temperatures, and/or when they are exposed to sunlight.

This increase in height is caused by roll-out of the annular supporting portion as the internal fluid pressure on the domed portion applies a downward force to the circumferential inner wall, and the circumferential inner wall applies a downward force on the annular supporting portion.

An increase in the height of a beverage container causes jamming at the containers in filling and conveying equipment, and unevenness in stacking.

As is known, a large quantity of containers are manufactured annually and the producers thereof are always seeking in reduce the amount of metal utilized in making containers while still maintaining the came operating characteristics.

Because of the large quantities of containers manufactured, a small reduction in metal thickness, even of one-half of one thousandth of an inch, with result in a substantial reduction in material costs.

SUMMARY OF THE INVENTION

According to the present invention, the dome reversal pressure of a drawn and ironed beverage container is increased without increasing the metal thickness, increasing the height of an inner wall that surrounds the domed portion, increasing the total dome height, or decreasing the dome radius.

Further, in the present invention, both increased resistance to roll-out of the annular supporting portion and increased cumulative drop height resistance are achieved without any increase in metal content, and without any changes in the general size or shape of the container.

A container which provides increased resistance to roll-out, increased dome reversal pressure, and increased cumulative drop height resistance includes a cylindrical outer wall that is disposed around a vertical axis, a bottom that is attached to the outer wall and that provides a supporting surface, and a bottom recess portion that is disposed radially inwardly of the supporting surface, that includes a center panel, or concave domed panel, and that includes a circumferential dome positioning portion that disposes the center panel a positional distance above the supporting surface.

The concave domed panel, or at least a portion thereof, includes a curvature in the range wherein additional increases in curvature result in a reduction in the static dome reversal pressure. That is, the radius of curvature is in the range wherein further reductions in the radius of curvature result in a reduction in the static done reversal pressure.

Further, in an optimized version of the present invention, the selected curvature is in the range wherein an appreciable percentage of the done reversal pressure has already been lost in containers made without all of the features of the present invention.

However, when this increased curvature of the concave domed panel is accompanied by strengthening of the bottom recess portion as taught in the present invention, both the roll-out resistance and the static dome reversal pressure are increased.

Further, in most or all of the embodiments taught herein, the cumulative drop resistance is increased in addition to increase in roll-out resistance and static dome reversal pressure.

In one embodiment of the present invention, the bottom recess portion includes a part thereof that in disposed at a first vertical distance above the supporting surface and at a first radial distance from the vertical axis; and the bottom recess portion also includes an adjacent part that is disposed at a greater vertical distance above the supporting surface and at a greater radial distance from the vertical axis than the first part.

That is, the bottom recess portion includes an adjacent part that extends radially outward from a first part that is closer to the supporting surface. In this configuration, this adjacent part extends circumferentially around the container, thereby providing an annular radial recess that hooks outwardly of the part of the bottom recess that is closer to the supporting surface.

In another embodiment of the present invention, the adjacent part is arcuate and extends for only a portion of the circumference of the bottom recess portion. Preferably a plurality of adjacent parts, and more preferably five adjacent parts, extend radially outward from a plurality of the first parts, and are interposed between respective ones of the first parts.

Generally speaking in the present invention, a plurality of strengthening parts are disposed in the circular inner wall of the bottom recess portion, and either extend circumferentially around the bottom recess portion or are circumferentially spaced. The strengthening parts project either radially outwardly or radially inwardly with respect to the circular inner wall.

The strengthening parts may be contained entirely within the inner wall, may extend downwardly into the annual supporting surface, portion, may extend upwardly into the concave annular portion that surrounds the domed portion, and/or may extend upwardly into both the concave annular portion and the concave domed panel.

The strengthening parts may be round, elongated vertically, may be elongated circumferentially, and/or may be elongated at an angle between vertical and circumferential.

In summary, the present invention provides a container with improved static domes reversal pressure without any increase in material, and without any change in dimensions that affects interchangeability of filling and/or packaging machinery.

Further, the present invention provides a container with enhanced resistance to pressure-caused roll-out and the resultant change in the overall height of the container that accompanies fluid pressure encountered during the pasteurizing process.

Finally, the present invention provides a container with improved cumulative drop height resistance without any increase in material, and without any changes in dimensions that affect interchangeability of filling machinery, thereby making possible a reducing of, or elimination of, cushioning that has been provided by carton and case packaging.

In a firs aspect of the present invention, a container with improved strength includes a cylindrical outer wall being disposed around a vertical axis, a bottom being attached to the outer wall and having a supporting surface, and a bottom recess portion of the bottom being disposed radially inwardly of the supporting surface, having a circular dome positioning portion with a convex annular portion that connects the bottom recess portion to the remainder of the bottom, and having a concave domed panel that is disposed above the supporting surface by the dome positioning portion, the improvement which comprises the concave domed panel having a curvature in the range wherein increases in the curvature decrease the static dome reversal pressure of the container, and means for increasing the roll-out resistance of the bottom recess portion.

In one variation of the first aspect, the concave domed panel has a portion thereof with a radius of curvature that is less than a specified percentage of the smallest inside diameter of the convex annular portion.

In another variation of the first aspect, the concave domed panel has a portion with a radius of curvature that is less than a specified dimension.

In a second aspect of the present invention, a method is provided for strengthening the bottom of a continuer having a cylindrical outer wall that is disposed around a vertical axis, having a bottom that is integral with the cylindrical outer wall and that includes a supporting surface, and having a bottom recess portion in the bottom that includes a circular dome positioning portion with a convex annular portion that connects the bottom recess portion to the remainder of the bottom, and that includes a concave domed panel that is disposed above the supporting surface by the dome positioning portion, which method comprises forming the domed panel with a curvature in the range wherein increases in the curvature decrease the static dome reversal pressure of the container, and increasing the roll-out resistance of the convex annular portion.

In one variation of the second aspect, the concave domed panel has a portion thereof which has a radius of curvature that is between specified percentages of the smallest inside diameter of the convex annular portion.

In another variation of the second aspect, the concave domed panel has a portion thereof which has a radius of curvature that is between specified dimensions.

In a third aspect of the present invention, a container with increased strength includes a cylindrical outer wall that is disposed circumferentially around a vertical axis a bottom that is attached to the outer wall and that provides a supporting surface, a bottom recess portion that is disposed radially inwardly of the supporting surface and that includes a convex annular portion, a concave domed panel, and a circular dome positioning portion that is interposed between the convex annular portion and the concave domed panel, the concave domed panel having a curvature in the range wherein increases in the curvature decrease the static dome reversal pressure of the container, and means, comprising a reworked part of the bottom recess portion for increasing the roll-out strength of the container.

In one various of the third aspect, the concave domed panel has a portion thereof with a radius of curvature that is less than a specified percentage of the smallest inside diameter of the convex annular portion.

In another variation of the third aspect, the concave domed panel has a portion thereof with a radius of curvature that is less than a specified dimension.

In a fourth aspect of the present invention, a method is provided for increasing the strength of a container having a cylindrical outer wall that is disposed around a vertical axis, and having a bottom that is attached to the outer wall and that provides a supporting surface, and that includes a bottom recess portion that is disposed radially inwardly of the supporting surface and that includes a convex annular portion, a concave domed panel, and a circular dome positioning portion that is interposed between the convex annular portion and the concave domed panel, which method comprises forming the concave domed panel with a portion having a curvature in the range wherein increase in the curvature decrease the static dome reversal pressure of the container, and increasing the static dome reversal pressure by reworking a part of the bottom recess portion.

In one variation of the fourth aspect, the concave domed panel has a portion with a radius of curvature that is between specified percentage of the smallest inside diameter of the convex annular portion.

In another variation of the fourth aspect, the concave domed panel has a portion with a radius of curvature that is between specified dimensions.

In a fifth aspect of the present invention, a container with improved strength comprises an outer wall being disposed around a vertical axis; a bottom being attached is the outer wall, having an inner wall, and having a center panel that is disposed upwardly by the inner wall; the concave domed panel having a curvature in the range wherein increases in the curvature decrease the static come reversal pressure of the container; and the inner wall including at least a part thereof that slopes outwardly and upwardly.

In a first variation of the fifth aspect, the part is substantially circumferentially and in a second variation of the fifth aspect, the container includes another part that slopes upwardly and outwardly, and that is circumferentially spaced from the first part.

DESCRIPTION OF THE PREFERRED EMBODIMENTS

Figure 3:
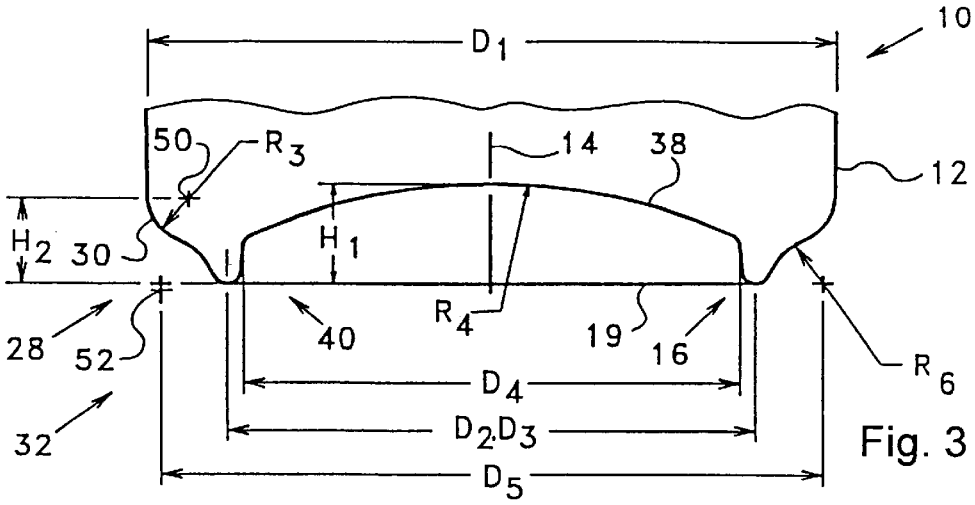
FIG. 3 is a cross sectional elevation of the lower portion of one of the beverage containers of FIGS. 1 and 2, showing details that are generally common to two prior art designs.
Figure 4:
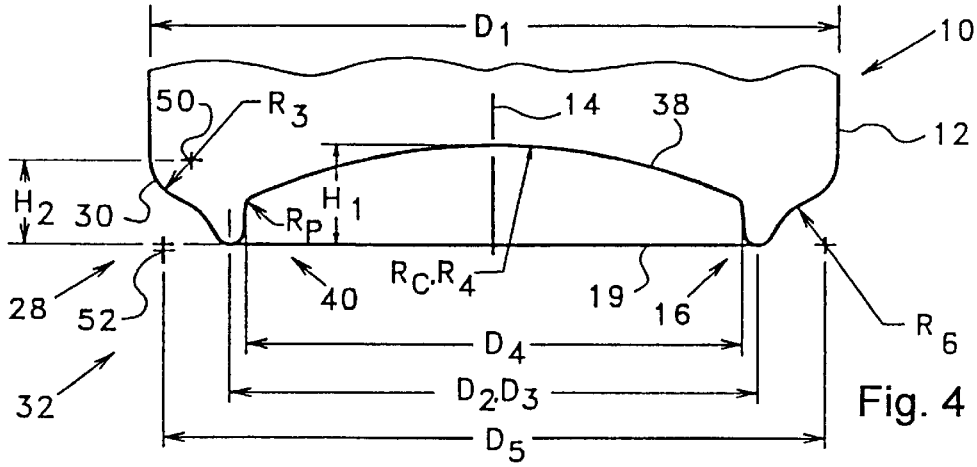
FIG. 4 is a cross sectional elevation of the lesser portion of a beverage container, showing details that are generally common to those of FIG. 4, which, together with dimensions as provided herein, is used to described a first embodiment of the present invention.
Figure 5:
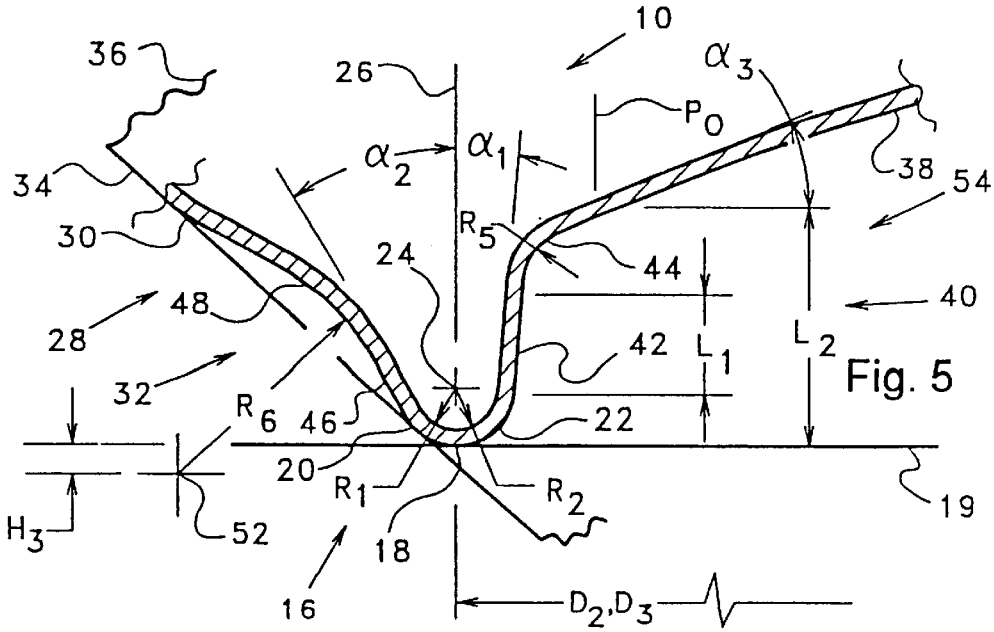
FIG. 5 is a cross sectional elevation, showing, at an enlarged scale, details that are generally common to both FIGS. 3 and 4.

Referring now to FIGS. 3, 4, and 5, there configurations are generally common to Pulciani et al. in U.S. Pat. Nos. 4,585,582 and 4,768,672, to a design manufactured by the assignee of the present invention, and to embodiments of the present invention. More particularly, FIG. 3 is common to the aforesaid prior art, FIG. 4 is common to two embodiments of the prior art, and FIG. 5 shows some details of FIGS. 3 and 4 in an enlarged scale.

Since the present invention differs from the prior art primarily by selection of some of the parameters shown in FIGS. 3–5, the forthcoming description refers to all those drawings, except as stated otherwise, and some dimensions pertaining to FIGS. 3 and 4 are placed only on FIG. 5 in order to avoid crowding.

Continuing to referring FIGS. 3–5, a drawn and ironed beverage container 10 includes a generally cylindrical sidewall 12 that includes a first diameter $D_1$, and that is disposed circumferentially around a vertical axis 14; and an annular supporting portion, of annular supporting means, 16 that is disposed circumferentially around the vertical axis 14, that is disposed radially inwardly from the sidewall 12, and that provides an annular supporting surface 18 that coincides with a base line 19.

The annular supporting portion 16 includes an outer convex annular portion 20 that preferably is arcuate, and an inner convex annular portion 22 that preferably is arcuate, that is disposed radially inwardly from the outer convex annular portion 20, and that is connected to the outer convex annular portion 20. The outer and inner convex annular portions, 20 and 22, have radii $R_1$ and $R_2$ whose centers of curvature are common. More particularly, the radii $R_1$ and $R_2$ both have centers of curvature of a point 24, and of a circle of revolution 26 of the point 24. The circle of revolution 26 has a second diameter $D_2$.

An outer connecting portion, or outer connecting means, 28 includes an upper convex annular portion 30 that is preferably arcuate, that includes a radius of $R_3$, and that is connected to the sidewall 12. The outer connecting portion 28 also includes a recessed annular portion 32 that is disposed radially inwardly of a line 34, or a frustoconical surface of revolution 36, that is tangent to the outer convex annular portion 20 and the upper convex annular portion 30. Thus, the outer connecting means 28 connects the sidewall 12 to the outer convex annular portion 20.

A center panel, or concave domed panel, 38 is preferably spherically-shaped, but may be of any suitable curved shape, has an approximate radius of curvature, or dome radius, $R_1$, is disposed radially inwardly from the annular supporting portion 16, and curves upwardly into the container 10. That is, the domed panel 28 curves upwardly proximal to the vertical axis 14 when the container 10 is in an upright position.

The container 10 further includes an inner connecting portion, or inner connecting means, 40 having a circumferential inner wall, or cylindrical inner wall, 42 with a height $L_1$ that extends upwardly with respect to the vertical axis 14 that may be cylindrical, or that may be frustoconical and slope inwardly toward the vertical axis 14 at an angle $\alpha_1$. The inner connecting portion 40 also includes an inner concave annular portion 44 that has a radius of curvature $R_5$, and that interconnects the inner wall 42 and the domed panel 38. Thus, the inner connecting portion 40 connects the domed panel 38 to the annular supporting portion 16.

The inner connecting portion 40 positions a perimeter $P_0$ of the domed panel D8 at a positional distance $L_2$ above the base line 19. As can be seen by inspection of FIG. 6, the positional distance $L_2$ is approximately equal to, but is somewhat lens than, the sum of the height $L_1$ of the inner wall 42, the radius of curvature $R_5$ of the inner concave annular portion 44, the radius $R_2$ of the inner convex annular portion 22, and the thickness of the material at the inner convex annular portion 22.

As seen by inspection and as can be calculated by trigonometry, the positional distance $L_2$ is less than the aforementioned sum by a function of the angle $\alpha_1$, and as a function of an angle $\alpha_3$ at which the perimeter $P_0$ of the domed panel 38 is connected to the inner concave annular portion 44.

For example, if the radius $R_5$ of the inner concave annular portion 44 is 0.050 inches, if the radius $R_2$ of the inner convex annular portion 22 is 0.040 inches, and if the thickness of the material of the inner convex annular portion 22 is along 0.012 inches, then the positional distance $L_2$ is about, but somewhat less than 0.102 inches more than the height $L_1$ of the inner wall 42.

Thus, with radii and metal thickness as noted above, when the height $L_1$ of the inner wall 42 is 0.060 inches, the positional distance $L_2$ is about, but little less than 0.162 inches.

The annular supporting portion 16 has an arithmetical mean diameter $D_1$ that occurs at the function of the outer convex annular portion 20 and the inner convex annular portion 22. Thus, the mean diameter $D_2$ and the diameter $D_2$ of the circle 26 are the same diameter. The dome radius $R_4$ is centered on the vertical axis 14.

The recessed annular portion 32 includes a circumferential outer wall 46 that extends upwardly from the outer convex annular portion 20 and outwardly away from the vertical axis by an angle $\alpha_2$, and includes a lower concave annular portion 48 with a radius $R_6$. Further, the recessed annular portion 32 may, according to the selected magnitudes of the angle $\alpha_2$, the radius $R_3$, and the radius $R_6$, include a lower part of the upper convex annular portion 30.

Finally, the container 10 includes a dome height, or panel height, $H_1$ as measured from the supporting surface 18 to the domed panel 38, and a post diameter, or smaller diameter, $D_r$, of the inner wall 42. The upper convex annular portion 90 is tangent to the sidewall 12, and has a center 50. The center 50 is at a height $H_2$ above the supporting surface 18. A center 52 of the lower concave annular portion 48 is on a diameter $D_5$. The center 52 is below the supporting surface 18. More specifically, the supporting surface 18 is at a distance $H_3$ above the center 52.

Referring now to FIGS. 3 and 5, in the prior art embodiment of the three Pulciani, et al., patents, the following dimensions were used: $D_1$=2.507 inches; $D_2$, $D_3$=2.000 inches: $D_5$=2.365 inches; $R_1$, $R_2$=0.040 inches; $R_1$=0.200 inches; $R_4$=2.375 inches, $R_5$=0.050 inches; $R_1$=0.100 inches; and $\alpha_1$=less than $5^6$.

Referring again to FIGS. 3 and 5, in the prior art embodiment of the assignee to the present invention the following dimensions were used: $D_1$=2.598 inches; $D_1$, $D_2$=2.000 inches; $D_4$=1.882 inches; $D_5$=2.509 inches; $R_1$, $R_2$=0.040 inches; $R_3$=0.200 inches; $R_4$=2.375 inches; $R_5$=0.050 inches; $R_6$=0.200 inches; $H_1$=0.085 inches; $H_2$=0.370 inches; $H_3$=0.008 inches; $\alpha_1=5^9$ g'; and $\alpha_2=30^0$.

Referring now to FIGS. 4 and 5, in tests run in conjunction with the parent of the present Continuation-in-Part application, the following dimensions were used: $D_1$=2.598 inches: $D_2$, $D_3$=2.000 inches; $D_5$=2.509 inches; $R_1$, $R_2$=0.040 inches; $R_3$=0.200 inches; $R_5$=0.050 inches; $R_6$=0.200 inches; $H_2$=0.370 inches; $H_3$=0.008 inches, and $\alpha_1=30^0$.

the other dimensions, such as $R_4$, $D_4$, $H_1$, $\alpha_1$, $L_1$, and the thickness of material which were used in the tests, are as specified in the tables which are included herein, together with the test results thereof.

In each of the tables, the static dome reversal pressure (S.D.R.) is in pounds per square inch, the cumulative drop height (C.D.H.) is inches, and the internal pressure (I.P.) at which the cumulative drop height tests were run is in pounds per square inch.

Referring new to Tables 1–10, the radius of curvature $R_4$ of the domed panel 38, as specified in the tables, is the approximate radius of curvature of the container, as pressured, not the radius of curvature of the domer tooling. For instance, a radius of curvature $R_4$ of approximately 2.375 inches, is made with a tool that has a radius of 2.120 inches.

This difference in radius of curvature between the container and the tooling is true for the three Pulciani et al. patents, for the prior art embodiments of the assignee of the present invention, and also for the present invention.

More particularly in the following Table A the comparison between tooling radius and the actual dome radius $R_4$ of the containers is shown.

TABLE A

| Tooling Dimension | Container Dimension |
|---|---|
| 2.12 inches | 2.375 inches |
| 2.05 inches | 2.288 inches |
| 1.95 inches | 2.163 inches |
| 1.85 inches | 2.038 inches |
| 1.75 inches | 1.913 inches |
| 1.65 inches | 1.750 inches |

Therefore, in the tables, a radius of curvature $R_4$ of 2.375 compares to the prior art of FIGS. 3 and 4, in which the radius of the domer tooling was 2.120 inches; and the improvements of the present invention, at other radii of curvature, can be seen as a comparison to a radius of curvature $R_4$ of 2.375 inches.

The tests of Tables 1–10 were run with two thickness of metal, as specified. The 0.0118 inch thickness is the standard gauge for use in the United States; and the 0.0127 inch thickness is used for special orders, particularly for use outside the United States. All of the test material was aluminum alloy which is designated as 3104 H19, and the test material was takes from production stock.

The cumulative drop heights in Tables 1–12 represent the average of eighteen tests, and the static dome reversal pressures represent the average of ten tests. The internal fluid pressures in each container prior to dropping is shown in the table for each drop test.

The purpose for the cumulative drop height is to determine the cumulative drop height at which a filled can exhibit partial or total reversal of the domed panel.

The procedure is as follows: 1) warm the product in the containers to 90 degrees, plus or minus 2 degrees. Fahrenheit; 2) position the tube of the drop height tester to 5 degrees from vertical to achieve consistent container drops; 3) insert the container from the top of the tube, lower it to the 3 inch position, and support the container with a finger; 4) allow the container to free-fall and strike the street base; 5) repeat the test at heights that successively increase by 3 inch increments; 6) feel the domed panel to check for any bulging of "reversal" of the domed panel before testing at the next height; 7) record the height at which dome reversal occurs; 8) calculate the cumulative drop height, that is, and each height at which a given container has been dropped, including the height at which dome reversal occurs; and 9) average the results from 10 containers.

TABLE 1

| Thkns: | 0.0118 | 0.0127 | 0.0118 | 0.0127 |
|---|---|---|---|---|
| $R_4$ | 2.375 | 2.375 | 2.375 | 2.375 |
| $D_4$ | 1.8820 | 1.8820 | 1.8820 | 1.8820 |
| $H_1$ | 0.3861 | 0.3832 | 0.3861 | 0.3832 |
| $\alpha_1$ | 3.0 | 2.0 | 3.0 | 2.0 |
| $L_1$ | 0.110 | 0.090 | 0.110 | 0.090 |
| S.D.R. | 95.8 | 110.9 | 95.8 | 110.9 |
| C.D.H. | 5.0 | 17.5 | 5.0 | 17.5 |
| I.P. | 62.4 | 61.0 | 62.4 | 61.0 |
| $R_4/D_2$ | 1.188 | 1.188 | 1.188 | 1.188 |
| $R_4/D_1$ | 0.914 | 0.914 | 0.914 | 0.914 |
| $H_1/D_2$ | 0.193 | 1.192 | 0.193 | 0.192 |
| $H_1/D_1$ | 0.149 | 0.147 | 0.149 | 0.147 |
| $L_1/D_2$ | 0.055 | 0.045 | 0.055 | 0.045 |
| $L_1/D_1$ | 0.042 | 0.035 | 0.042 | 0.035 |

TABLE 2

| Thkns: | 0.0118 | 0.0127 | 0.0118 | 0.0127 |
|---|---|---|---|---|
| $R_4$ | 2.288 | 2.288 | 2.288 | 2.288 |
| $D_4$ | 1.8870 | 1.8870 | 1.8870 | 1.8870 |
| $H_1$ | 0.3855 | 0.3864 | 0.3855 | 0.3864 |
| $\alpha_1$ | 2.0 | 1.5 | 2.0 | 1.5 |
| $L_1$ | 0.095 | 0.090 | 0.095 | 0.090 |
| S.D.R. | 95.9 | 113.1 | 95.9 | 113.1 |
| C.D.H. | 9.0 | 23.6 | 9.0 | 23.6 |
| I.P. | 63.6 | 60.0 | 63.6 | 60.0 |
| $R_4/D_2$ | 1.144 | 1.144 | 1.144 | 1.144 |
| $R_4/D_1$ | 0.881 | 0.881 | 0.881 | 0.881 |
| $H_1/D_2$ | 0.193 | 0.193 | 0.193 | 0.193 |
| $H_1/D_1$ | 0.148 | 0.149 | 0.148 | 0.149 |
| $L_1/D_2$ | 0.048 | 0.045 | 0.048 | 0.045 |
| $L_1D_1$ | 0.037 | 0.035 | 0.037 | 0.035 |

TABLE 3

| Thkns: | 0.0118 | 0.0127 | 0.0118 | 0.0127 |
|---|---|---|---|---|
| $R_4$ | 2.288 | 2.288 | 2.288 | 2.288 |
| $D_4$ | 1.8820 | 1.8820 | 1.8820 | 1.8820 |
| $H_1$ | 0.3851 | 0.3851 | 0.3928 | 0.3851 |
| $\alpha_1$ | 2.0 | 2.0 | 1.5 | 2.0 |
| $L_1$ | 0.080 | 0.085 | 0.095 | 0.085 |
| S.D.R. | 94.3 | 109.7 | 95.5 | 109.7 |
| C.D.H. | 8.7 | 22.0 | 8.3 | 22.0 |
| I.P. | 63.2 | 62.2 | 64.7 | 62.2 |
| $R_4/D_2$ | 1.144 | 1.144 | 1.144 | 1.144 |
| $R_4/D_1$ | 0.881 | 0.881 | 0.881 | 0.881 |
| $H_1/D_2$ | 0.193 | 0.193 | 0.196 | 0.193 |

TABLE 3-continued

| Thkns: | 0.0118 | 0.0127 | 0.0118 | 0.0127 |
|---|---|---|---|---|
| $H_1/D_1$ | 0.148 | 0.148 | 0.151 | 0.148 |
| $L_1/D_2$ | 0.040 | 0.043 | 0.048 | 0.043 |
| $L_1/D_1$ | 0.031 | 0.033 | 0.037 | 0.033 |

TABLE 4

| Thkns: | 0.0118 | 0.0127 | 0.0118 | 0.0127 |
|---|---|---|---|---|
| $R_4$ | 2.163 | 2.163 | 2.163 | 2.163 |
| $D_4$ | 1.8870 | 1.8870 | 1.8870 | 1.8870 |
| $H_1$ | 0.3863 | 0.3856 | 0.4021 | 0.3971 |
| $\alpha_1$ | 1.5 | 1.0 | 1.5 | 1.5 |
| $L_1$ | 0.075 | 0.075 | 0.085 | 0.090 |
| S.D.R. | 92.9 | 106.0 | 96.9 | 111.7 |
| C.D.H. | 18.0 | 37.7 | 13.5 | 37.7 |
| I.P. | 62.6 | 62.5 | 64.8 | 62.8 |
| $R_4/D_2$ | 1.081 | 1.081 | 1.081 | 1.081 |
| $R_4/D_1$ | 0.833 | 0.833 | 0.833 | 0.833 |
| $H_1/D_2$ | 0.193 | 0.193 | 0.201 | 0.199 |
| $H_{11}$ | 0.149 | 0.148 | 0.155 | 0.153 |
| $L_1/D_2$ | 0.038 | 0.038 | 0.043 | 0.045 |
| $L_1/D_1$ | 0.029 | 0.029 | 0.033 | 0.035 |

TABLE 5

| Thkns: | 0.0118 | 0.0127 | 0.0118 | 0.0127 |
|---|---|---|---|---|
| $R_4$ | 2.163 | 2.163 | 2.163 | 2.163 |
| $D_4$ | 1.8820 | 1.8820 | 1.8820 | 1.8820 |
| $H_1$ | 0.3839 | 0.3839 | 0.4101 | 0.4057 |
| $\alpha_1$ | 2.0 | 2.75 | 2.5 | 1.25 |
| $L_1$ | 0.060 | 0.070 | 0.100 | 0.090 |
| S.D.R. | 89.2 | 104.7 | 97.5 | 112.7 |
| C.D.H. | 17.5 | 36.7 | 16.5 | 29.8 |
| I.P. | 63.0 | 61.2 | 63.3 | 63.3 |
| $R_4/D_2$ | 1.081 | 1.081 | 1.081 | 1.081 |
| $R_4/D_1$ | 0.833 | 0.833 | 0.833 | 0.833 |
| $H_1/D_2$ | 0.192 | 0.192 | 0.205 | 0.203 |
| $H_1/D_1$ | 0.148 | 0.148 | 0.158 | 0.156 |
| $L_1/D_2$ | 0.030 | 0.035 | 0.050 | 0.045 |
| $L_1/D_1$ | 0.023 | 0.027 | 0.038 | 0.035 |

TABLE 6

| Thkns: | 0.0118 | 0.0127 | 0.0118 | 0.0127 |
|---|---|---|---|---|
| $R_4$ | 2.038 | 2.038 | 2.038 | 2.038 |
| $D_4$ | 1.8870 | 1.8870 | 1.8870 | 1.8870 |
| $H_1$ | 0.3863 | 0.3851 | 0.4178 | 0.4137 |
| $\alpha_1$ | 1.5 | 1.0 | 1.0 | 1.5 |
| $L_1$ | 0.055 | 0.055 | 0.090 | 0.090 |
| S.D.R. | 87.9 | 102.4 | 97.2 | 112.8 |
| C.D.H. | 31.7 | 65.5 | 26.0 | 57.0 |
| I.P. | 63.0 | 60.3 | 62.5 | 61.3 |
| $R_4/D_2$ | 1.019 | 1.019 | 1.019 | 1.019 |
| $R_4/D_1$ | 0.784 | 0.784 | 0.784 | 0.784 |
| $H_1/D_2$ | 0.193 | 0.193 | 0.209 | 0.207 |
| $H_{11}$ | 0.149 | 0.148 | 0.161 | 0.159 |
| $L_1/D_2$ | 0.028 | 0.028 | 0.045 | 0.045 |
| $L_1/D_1$ | 0.021 | 0.021 | 0.035 | 0.035 |

TABLE 7

| Thkns: | 0.0118 | 0.0127 | 0.0118 | 0.0127 |
|---|---|---|---|---|
| $R_4$ | 2.038 | 2.038 | 2.038 | 2.038 |
| $D_4$ | 1.8820 | 1.8820 | 1.8820 | 1.8820 |
| $H_1$ | 0.3855 | 0.3865 | 0.4246 | 0.4222 |

TABLE 7-continued

| Thkns: | 0.0118 | 0.0127 | 0.0118 | 0.0127 |
|---|---|---|---|---|
| $\alpha_1$ | 4.5 | 2.0 | 2.5 | 1.5 |
| $L_1$ | 0.065 | 0.060 | 0.100 | 0.105 |
| S.D.R. | 86.1 | 101.8 | 98.4 | 113.4 |
| C.D.H. | 40.0 | 59.0 | 25.9 | 53.0 |
| I.P. | 60.5 | 63.2 | 62.4 | 64.2 |
| $R_4/D_2$ | 1.019 | 1.019 | 1.019 | 1.019 |
| $R_4/D_1$ | 0.784 | 0.784 | 0.784 | 0.784 |
| $H_1/D_2$ | 0.193 | 0.193 | 0.212 | 0.211 |
| $H_1/D_1$ | 0.148 | 0.149 | 0.163 | 0.163 |
| $L_1/D_2$ | 0.033 | 0.030 | 0.050 | 0.053 |
| $L_1/D_1$ | 0.025 | 0.023 | 0.038 | 0.040 |

TABLE 8

| Thkns: | 0.0118 | 0.0127 | 0.0118 | 0.0127 |
|---|---|---|---|---|
| $R_4$ | 1.913 | 1.913 | 1.913 | 1.913 |
| $D_4$ | 1.8870 | 1.8870 | 1.8870 | 1.8870 |
| $H_1$ | 0.3868 | 0.3852 | 0.4250 | 0.4216 |
| $\alpha_1$ | 3.0 | 2.5 | 1.5 | 2.0 |
| $L_1$ | 0.050 | 0.045 | 0.085 | 0.090 |
| S.D.R. | 85.5 | 101.7 | 96.0 | 111.0 |
| C.D.H. | 59.7 | 112.2 | 44.2 | 89.1 |
| I.P. | 60.6 | 63.5 | 61.3 | 60.0 |
| $R_4/D_4$ | 0.956 | 0.956 | 0.956 | 0.956 |
| $R_4/D_2$ | 0.736 | 0.736 | 0.736 | 0.736 |
| $H_1/D_2$ | 0.193 | 0.193 | 0.213 | 0.211 |
| $H_{11}$ | 0.149 | 0.148 | 0.164 | 0.162 |
| $L_1/D_2$ | 0.025 | 0.023 | 0.043 | 0.045 |
| $L_1/D_1$ | 0.019 | 0.017 | 0.033 | 0.035 |

TABLE 9

| Thkns: | 0.0118 | 0.0127 | 0.0118 | 0.0127 |
|---|---|---|---|---|
| $R_4$ | 1.913 | 1.913 | 1.913 | 1.913 |
| $D_4$ | 1.8820 | 1.8820 | 1.8820 | 1.8820 |
| $H_1$ | 0.3868 | 0.3843 | 0.4273 | 0.4265 |
| $\alpha_1$ | 5.0 | 5.0 | 3.5 | 2.5 |
| $L_1$ | 0.045 | 0.045 | 0.085 | 0.090 |
| S.D.R. | 84.3 | 99.5 | 93.2 | 108.9 |
| C.D.H. | 54.5 | 114.7 | 51.0 | 92.0 |
| I.P. | 62.7 | 60.2 | 61.2 | 63.3 |
| $R_4/D_2$ | 0.956 | 0.956 | 0.956 | 0.956 |
| $R_4/D_1$ | 0.736 | 0.736 | 0.736 | 0.736 |
| $H_1/D_2$ | 0.193 | 0.192 | 0.214 | 0.213 |
| $H_1/D_1$ | 0.149 | 0.148 | 0.164 | 0.164 |
| $L_1/D_2$ | 0.023 | 0.023 | 0.043 | 0.045 |
| $L_1/D_1$ | 0.017 | 0.017 | 0.033 | 0.035 |

TABLE 10

| Thkns: | 0.0118 | 0.0127 | 0.0118 | 0.0127 |
|---|---|---|---|---|
| $R_4$ | 1.750 | 1.750 | 1.750 | 1.750 |
| $D_4$ | 1.8870 | 1.8870 | 1.8870 | 1.8870 |
| $H_1$ | 0.3850 | 0.3850 | 0.4289 | 0.4275 |
| $\alpha_1$ | 4.0 | 5.0 | 2.5 | 2.0 |
| $L_1$ | 0.035 | 0.035 | 0.080 | 0.075 |
| S.D.R. | 83.3 | 98.6 | 91.4 | 106.9 |
| C.D.H. | 73.5 | 137.7 | 70.0 | 136.0 |
| I.P. | 63.6 | 60.4 | 64.8 | 62.7 |
| $R_4/D_2$ | 0.875 | 0.875 | 0.875 | 0.875 |
| $R_4/D_1$ | 0.674 | 0.674 | 0.674 | 0.674 |
| $H_1/D_2$ | 0.193 | 0.193 | 0.214 | 0.214 |
| $H_{11}$ | 0.148 | 0.148 | 0.165 | 0.165 |
| $L_1/D_2$ | 0.018 | 0.018 | 0.040 | 0.038 |
| $L_1/D_1$ | 0.013 | 0.013 | 0.031 | 0.029 |

TABLE 11

Constant Dome Depth

| Thkns. | $R_4$ | $D_4$ | SDR .0118 | SDR .0127 | CDH .0118 | CDH .0127 |
|---|---|---|---|---|---|---|
| B6A | 2.375 | 1.882 | 95.8 | 110.9 | 5.0 | 17.5 |
| X0133 | 2.288 | 1.887 | 95.9 | 113.1 | 9.0 | 23.6 |
| X0132 | 2.288 | 1.882 | 94.3 | 109.7 | 8.7 | 22.0 |
| X0131 | 2.163 | 1.887 | 92.9 | 106.0 | 18.0 | 37.7 |
| X0130 | 2.163 | 1.882 | 89.2 | 104.7 | 17.5 | 36.7 |
| X0129 | 2.038 | 1.887 | 87.9 | 102.4 | 31.7 | 65.5 |
| X0123 | 2.038 | 1.882 | 86.1 | 101.8 | 40.0 | 59.0 |
| X0128 | 1.913 | 1.887 | 85.5 | 101.7 | 59.7 | 112.2 |
| X0113 | 1.913 | 1.882 | 84.3 | 99.5 | 54.6 | 114.7 |
| X0135 | 1.750 | 1.887 | 83.3 | 98.6 | 73.5 | 137.7 |

TABLE 12

Constant SDR

| Thkns. | $R_4$ | $D_4$ | $H_1$ .0118 | $H_1$ .0127 | CDH .0118 | CDH .0127 |
|---|---|---|---|---|---|---|
| B6A | 2.375 | 1.882 | .386 | .383 | 5.0 | 17.5 |
| X0133 | 2.288 | 1.887 | .386 | .386 | 9.0 | 23.6 |
| X0132 | 2.288 | 1.882 | .393 | .385 | 8.3 | 22.0 |
| X0131 | 2.163 | 1.887 | .402 | .397 | 13.5 | 37.7 |
| X0130 | 2.163 | 1.882 | .410 | .406 | 16.5 | 29.8 |
| X0129 | 2.038 | 1.887 | .418 | .414 | 26.0 | 57.0 |
| X0123 | 2.038 | 1.882 | .425 | .422 | 25.9 | 53.0 |
| X0128 | 1.913 | 1.887 | .425 | .422 | 44.2 | 89.1 |
| X0113 | 1.913 | 1.882 | .427 | .427 | 51.0 | 92.0 |
| X0135 | 1.750 | 1.887 | .429 | .428 | 70.0 | 136.0 |

Referring now to Table 1, it will be noticed that the numbers in columns three and four correspond exactly is the numbers in columns one and two. The reason for this is that the object in the tests for columns three and four was to vary the dome depths to match the static dome reversal of the prior art of FIG. 4. Since the parameters of Table 1 are the same as that of the prior art of FIG. 4, the numbers in columns three and four are identical to those in columns one and two.

Continuing to refer to Table 1, the test results for the prior art configuration of FIG. 4, the cumulative drop heights were 5.0 inches and 17.5 inches, for metal thicknesses of 0.0118 inches and 0.0127 inches respectively, and with internal pressures of 62.4 pounds per square inch and 61.0 pounds per square inch, respectively. Notice that the static dome reversal pressures were 95.8 and 110.9 pounds per square inch for the two metal thicknesses.

It is important to remember that the radius of curvature of the concave domed panel for Table 1, as listed, is approximately 2.375 inches, and that this is the radius of curvature for prior art containers in which the domer tooling radius is 2.120 inches.

Referring now to Table 10, in stark contrast to test results on the prior art embodiment of Table 1, with a dome radius $R_4$ of 1.750 inches of the container, and with a post diameter $D_4$ of 1.887 inches for the same two metal thicknesses. 0.118 inches and 0.0127 inches, and for internal pressures of 63.6 psi and 60.4 psi, respectively, the cumulative drop heights of the present invention were 73.5 inches and 137.7 inches, respectively, as shown in columns one and two. Notice that the static dome reversal pressures were 83.3 psi and 98.6 psi, respectively.

That is, the present invention increased the cumulative drop height by more than fourteen times, from 5.0 inches to 73.5 inches for the thinner stock, and by nearly eight times, from 17.5 inches to 137.7 inches for the thicker stock.

However, referring to Tables 1 and 10, this dramatic increase in the cumulative drop height was accompanied by an undesirably large decrease in the static dome reversal pressures. The dome reversal pressures reduced from 95.8 psi and 110.9 psi, respectively, for the thinner and the thicker stock in Table 1, to 83.3 psi and98.6 psi, respectively, for the thinner and the thicker stock of Table 10.

The present invention provides means for obviating, or at least amellorating, this decrease in the static dome reversal pressure that accompanies the dramatic increase in the cumulative drop height.

Referring now to Table 1 and to columns three and four of Table 10, the present invention increased the cumulative drop height from 5.0 inches and 17.5 inches, respectively, to 70.0 inches and 136.0 inches, respectively, for the thinner and the thicker stock. Therefore, the present invention increased the cumulative drop height by fourteen times for the thinner stock and by almost eight times for the thicker stock.

At the same time, by increasing the dome height $H_1$ from 0.3861 to 0.4289 inches for the thinner stock, and from 0.3832 to 0.4275 inches for the thicker stock, the decrease in dome radii $R_4$ from 2.375 to 1.750 inches limited decreases in the height $L_1$ of the inner wall 42, from 0.100 inches to 0.080 inches for the thinner stock and from 0.090 to 0.075 inches for the ticker stock. so that the containers of Table 10 maintained a static dome reversal pressure of 91.4 psi and 106.9 psi respectively.

Therefore, increasing the dome height $H_1$ of the inner wall 42, together with decreasing the dome radii $R_4$, limited the reduction in the static dome reversal pressure to less than 5 percent for the thinner stock, and by 4 percent for the thicker stock, while achieving increases in the cumulative drop height by about eight to fourteen times, depending upon the metal thickness.

Figure 6:
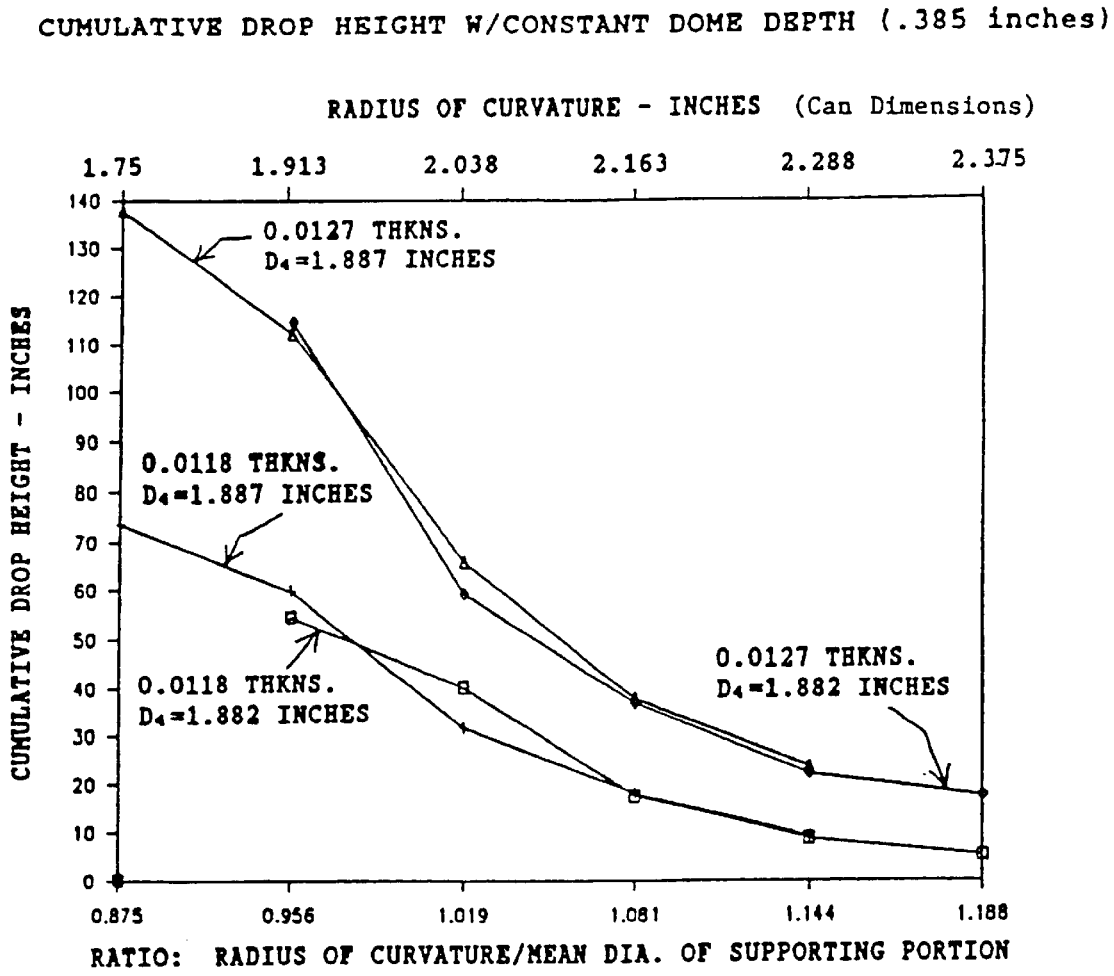
FIG. 6 is a grain of cumulative drop heights vs. both the radius of curvature of the domed panel, and the ratio of the radius of curvature divided by the mean diameter of the annular supporting portion, with the distance from the supporting surface to the domed panel being constant.

Referring now to FIG. 6, cumulative drop heights and static dome reversal pressures are shown for various radii of curvature $R_4$ of the domed panel 38, and for various ratios of radii of curvature $R_4$ to the mean diameter $D_2$ of the annular supporting portion 16.

Notice that in FIG. 6, with increasing heights $L_1$ of the inner wall 42, it is possible to obtain phenomenal, but not maximum, increases in the cumulative drop heights without decreasing the static dome reversal pressure below that which was achieved by the prior art.

Or, referring now to Tables 1 and 8, notice the prior art static dome reversal pressures of 95.8 and 110.9 of Table 1, are exceeded by the static dome reversal pressures of 96.0 and 111.0 of Table 8, and that increases in cumulative drop heights from 5.0 inches to 44.2 inches, and from 17.5 inches to 89.1 inches, respectively, are achieved.

Therefore, in the present invention, highly significant increases in the cumulative drop heights can be achieved without any reduction in static dome reversal pressures.

Furthermore, it is believed that further improvement is possible by varying such parameters as the angle $\alpha_1$ of the inner wall 42, and the height $L_1$ of the inner wall 42; because the test results submitted herein indicate that increasing the height $L_1$ increases the static dome reversal pressure, and decreasing the angle $\alpha_1$ of the inner wall 42 increases the static dome reversal pressures.

Referring now to FIG. 6 and Table 11, the test data of Tables 1–10 has been rearranged in Table 11 to show variations in test results when the dome height $H_1$ is kept constant; and in FIG. 6, the data of Table 11 is plotted to show the cumulative drop heights vs. the radius of curvature $R_4$ for tests wherein the dome height $H_1$ is kept constant at 0.385 inches.

It should be noted that in Tables 11 and 12, the designation B6A denotes a container made in accordance with the dimensions presently given for the prior art contained of the assignee of the subject invention. The other container designations (e.g., X0133) refer to experimental drawing numbers of various experimental tools.

Figure 7:
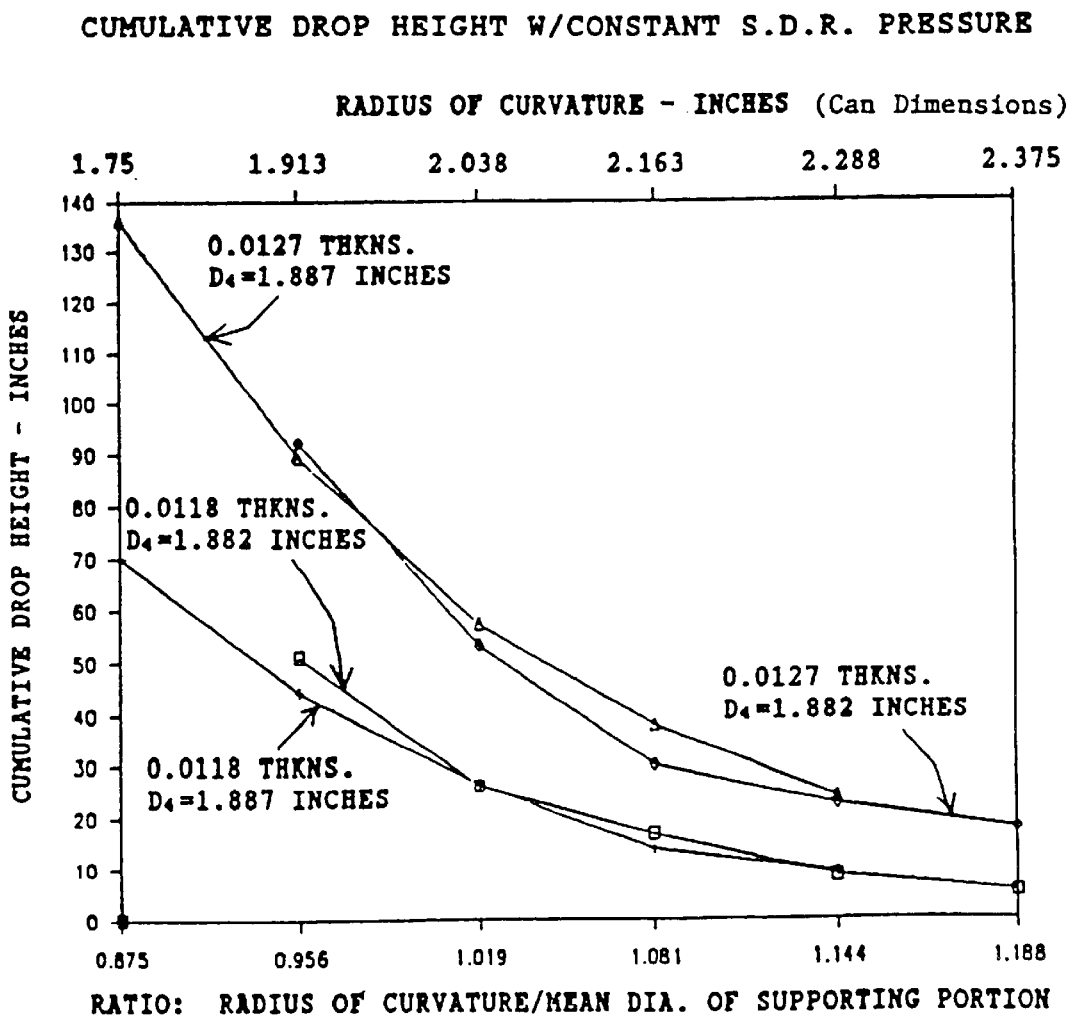
FIG. 7 is a grain of cumulative drop heights vs. both the radius of curvature of the domed panel, and the ratio of the radius of curvature divided by the mean diameter of the annular supporting portion, and is different from the graph of FIG. 6 in that parameters, such as the inner wall height have been selected in that parameters, such as the inner wall height, have been selected in provide a constant static dome reversal pressure.

In like manner, referring now to FIG. 7 and Table 12, the test data of Tables 1–10 has been rearranged in Table 12 to show variations in test results when he dome height $H_1$ is varied to maintain a constant, or nearly constant, static dome reversal pressure of 96 psi for the 0.0118 stock thickness and 111 psi for the 0.0127 stock thickness. In FIG. 7, the data of Table 12 is plotted to show the cumulative drop heights vs. the radius of curvature $R_4$ for tests wherein the static dome reversal pressure is kept constant, or nearly constant, as noted for Table 12.

Figure 8:
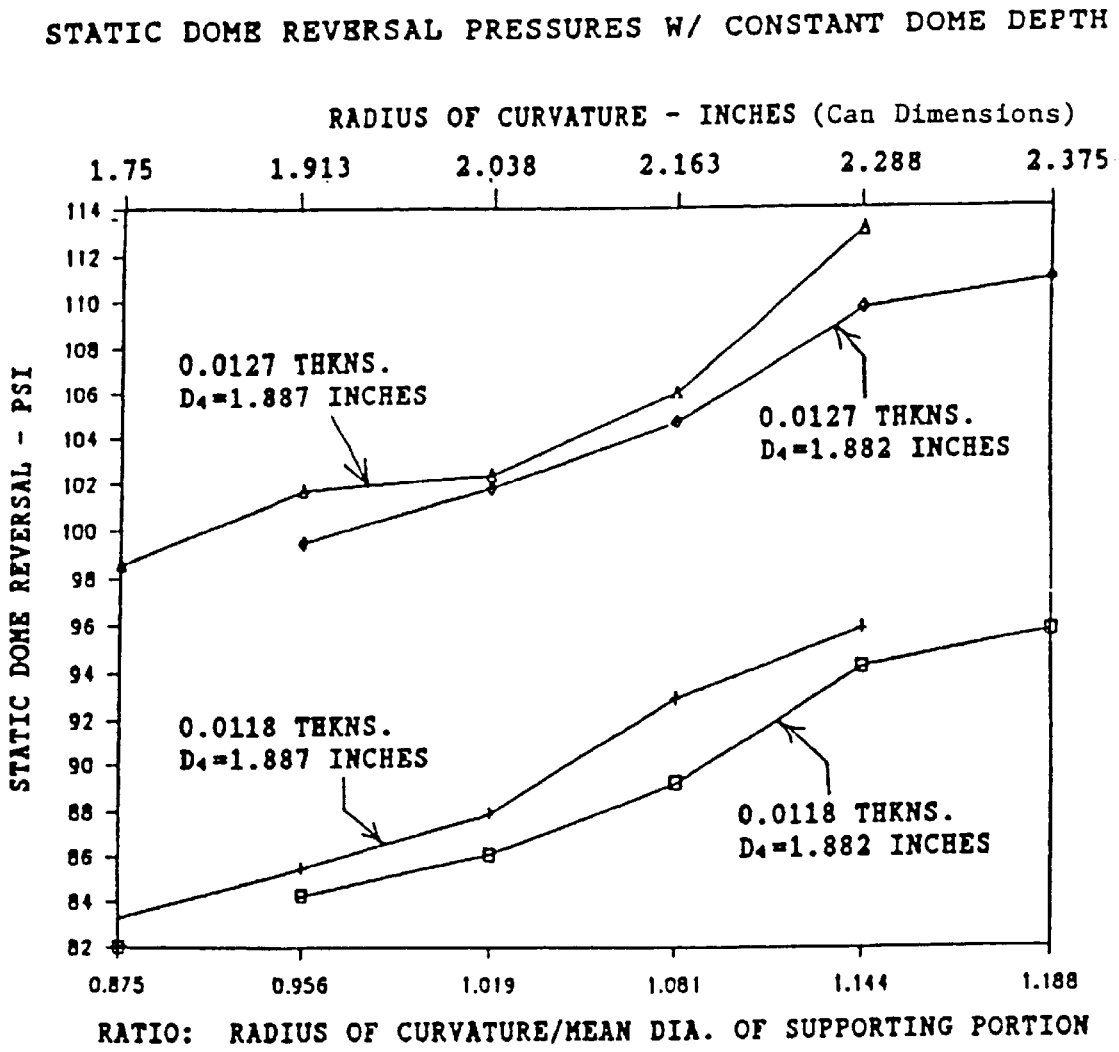
FIG. 8 is a graph of static dome reversal pressure vs. both the radius of curvature, and the ratio of the radius of curvature divided by the mean diameter of the annular supporting portion, with the dome height, that is, the distance from the supporting surface to the domed panel, being constant.
Figure 9:
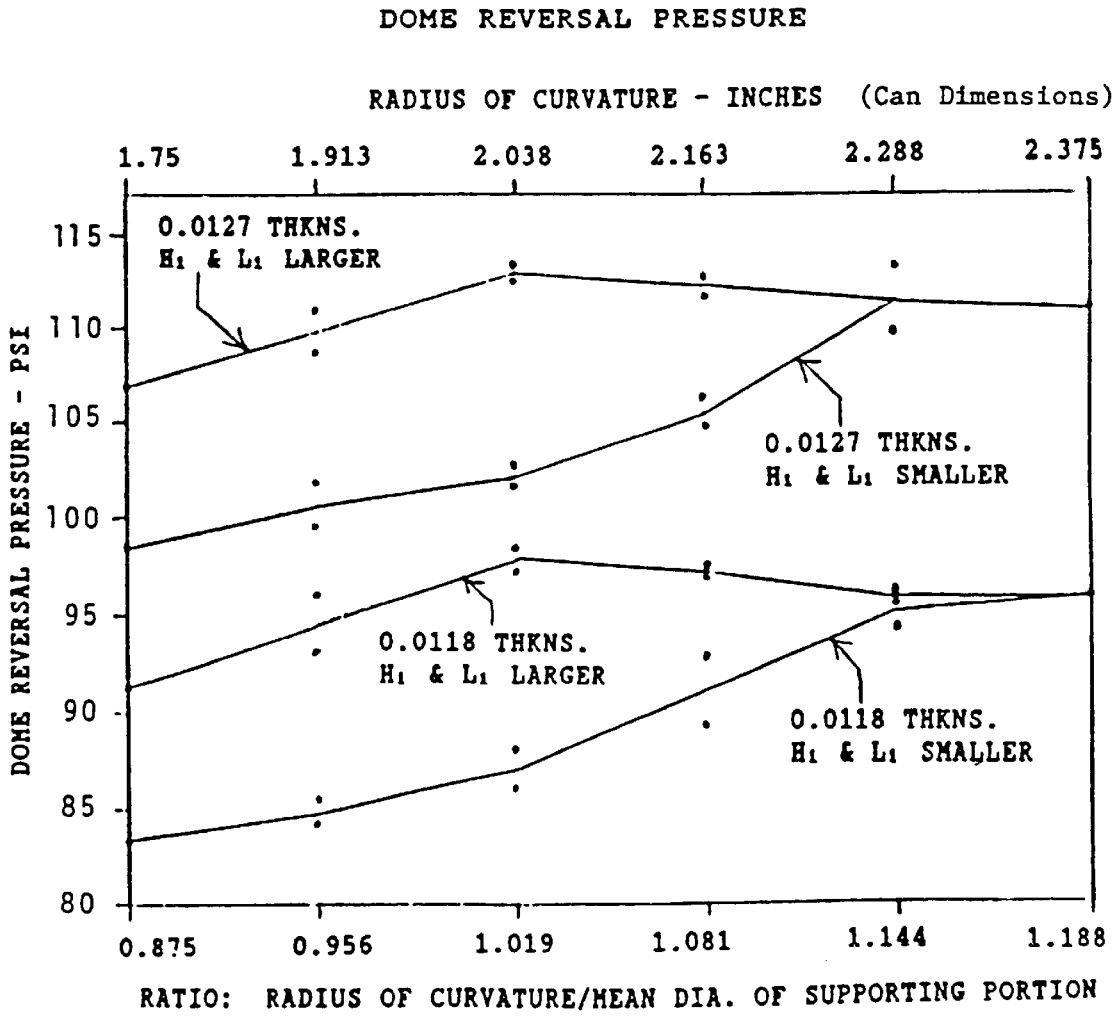
FIG. 9 is a graph of static dome reversal pressure vs. both the radius of curvature of the domed panel, and the ratio of the radius of curvature divided by the mean diameter of the annular supporting portion.

Referring now to FIG. 8, the static dome reversal pressures are plotted for various radii of curvature $R_4$ of the domed panel 38, and for various ratios of radii of curvature $R_4$ to the mean diameter $D_3$ of the annular supporting portion 16. In the curves of FIG. 8, the dome height $H_1$, that is, the distance from the supporting surface 18 to the domed panel 38 along the axis 14, is kept constant at 0.385 inches.

As shown and described above, reducing the radius $R_4$ results in an increase in cumulative drop height (C.D.H.), but also results in a detrimental decrease in the static dome reversal pressure (S.D.R.).

However, also as shown above, this detrimental decrease in the static dome reversal pressure can be obviated by increasing the height $L_1$ of the inner wall 42. Thus, by optimizing both the radius $R_4$ and the height $L_1$ of the inner wall 42, the container 10 provides an improved cumulative drop height while maintaining a highly acceptable static dome reversal pressure.

One container made in accordance with these teachings is referred to herein as the Tampa container; and the dimensions of the Tampa container which differ from a B6A container are shown in the third column of Table 6. A container made according to the prior art configuration of FIGS. 3 and 5 is referred to herein as a B6A container; and some of the dimensions of the B6A container are shown in the first column of Table 1.

As shown in Tables 1 and 6, the Tampa container has a static dome reversal pressure of 97.2 psi as opposed to 95.8 for the B6A container. Therefore, the Tampa container has a dome reversal pressure that is slightly higher than that of the B6A container.

However, as shown in Tables 1 and 6, the Tampa container has a cumulative drop height of 26.0 inches as opposed to 5.0 inches for the B6A container. Therefore, the Tampa container has a cumulative drop height resistance that is more than five times the cumulative drop height resistance of the B6A container.

Referring now to FIGS. 10–16, the containers, 62 and 64, and the following descriptive material have been added to U.S. patent application Ser. No. 07/505,618 to make the present Continuation-in-Part.

Figure 10:
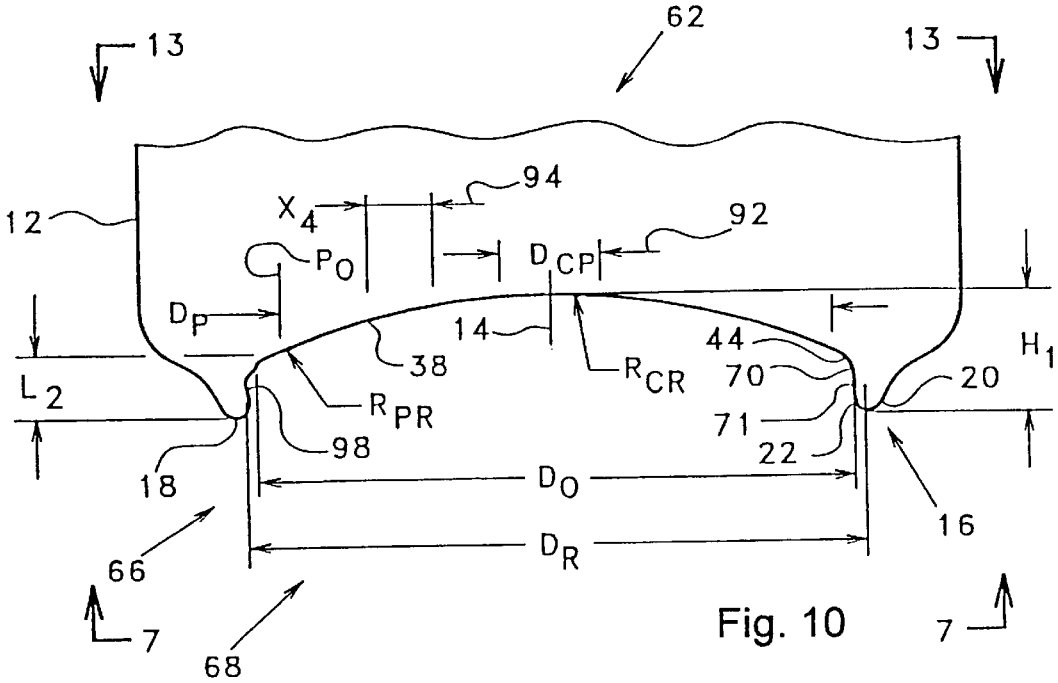
FIG. 10 is a slightly enlarged outline, taken generally as a cross sectional elevation, of the lower portion of the outer contour of a container of an embodiment of the present invention wherein a plurality of arcuately shaped and circumferentially spaced parts of the inner sidewall are disposed radially outward of other parts of the sidewall.
Figure 11:
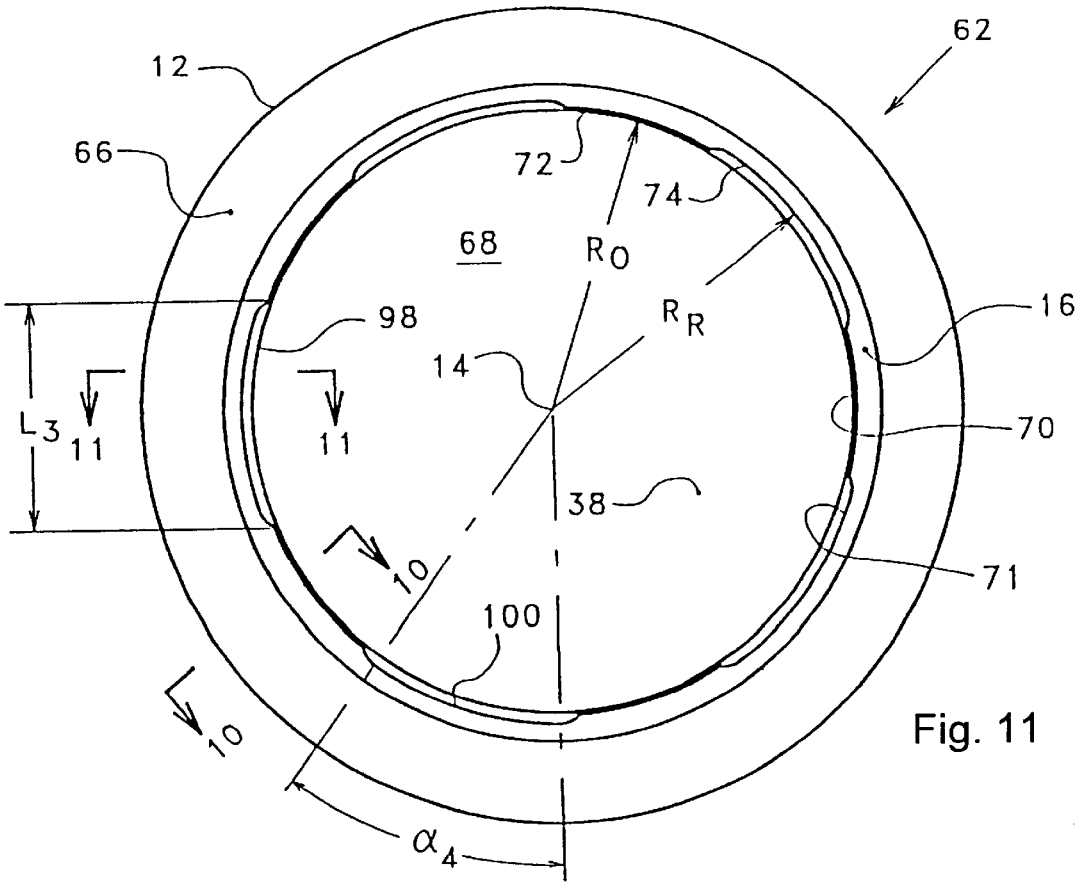
FIG. 11 is a bottom view of the container of FIG. 10, taken substantially as shown by view line II—II of FIG. 10.
Figure 12:
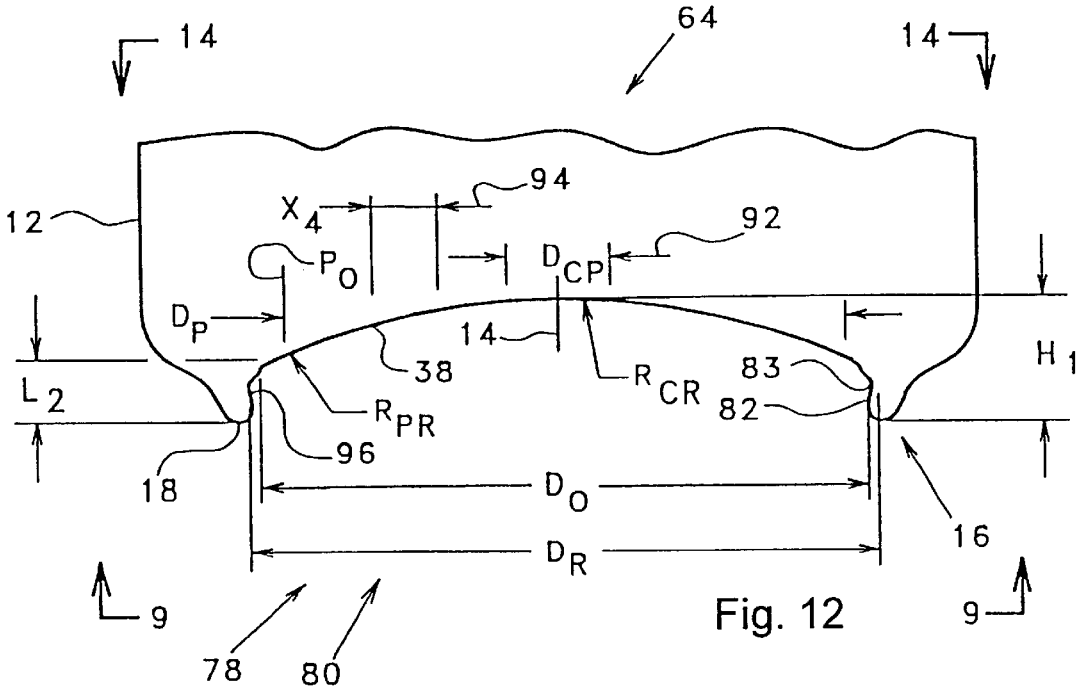
FIG. 12 is a slightly enlarged outline, taken generally as a cross sectional elevation, of the lower portion of the outer contour of a container made according to an embodiment of the present invention wherein a circumferential part of the inner sidewall is disposed radially outward of another circumferential part of the sidewall.
Figure 13:
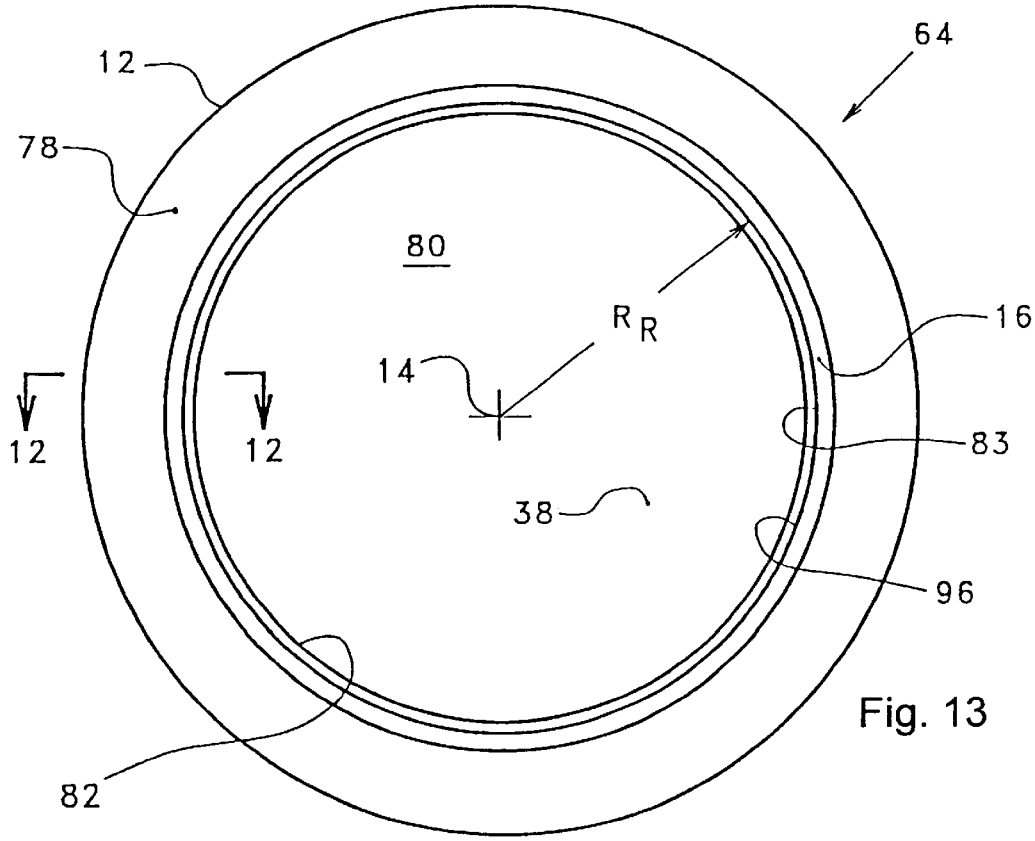
FIG. 13 is a bottom view of the container of FIG. 12, taken substantially as shown be view line 13—13 of FIG. 12.
Figure 14:
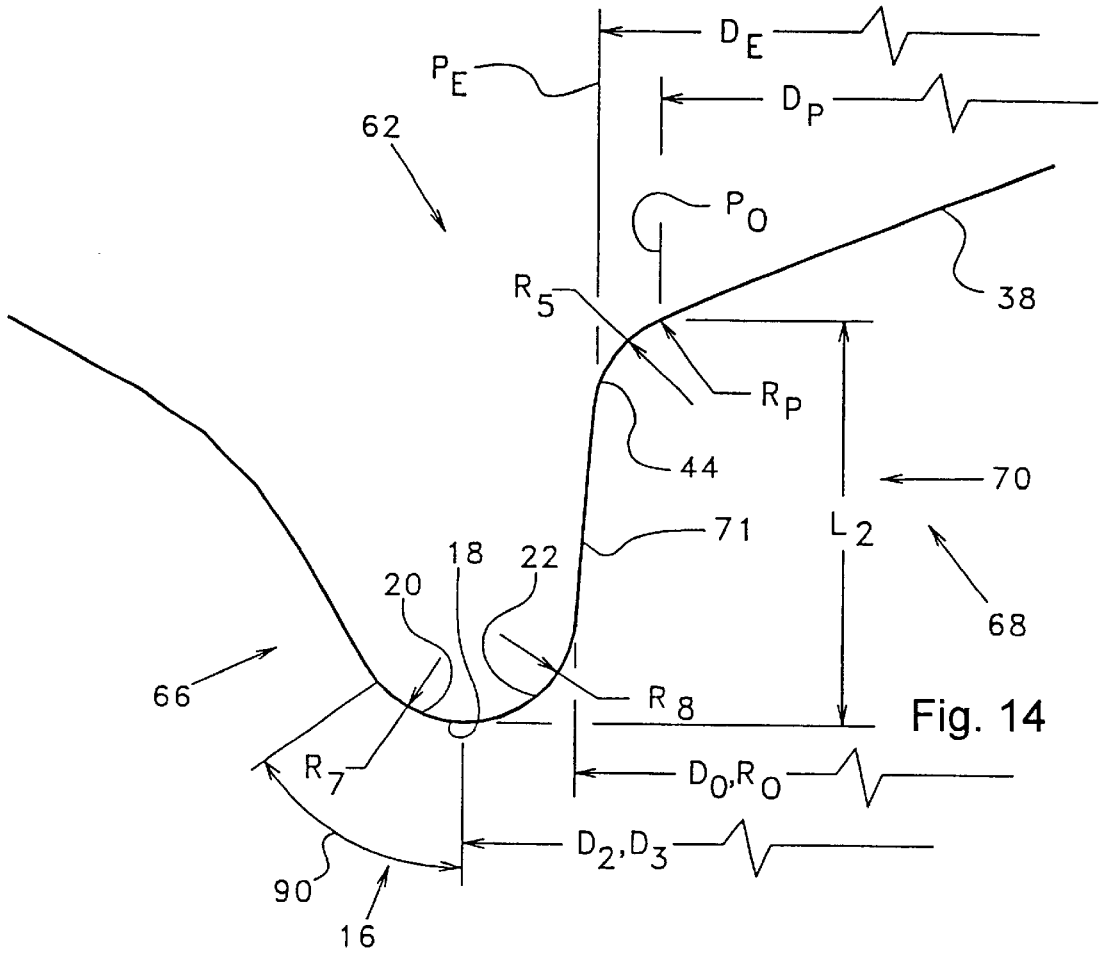
FIG. 14 is a fragmentary and greatly enlarged outline, taken generally as a cross sectional elevation, of the outer contour of the container of FIGS. 10 and 11, taken substantially as shown by section line 14—14 of FIG. 11.
Figure 15:
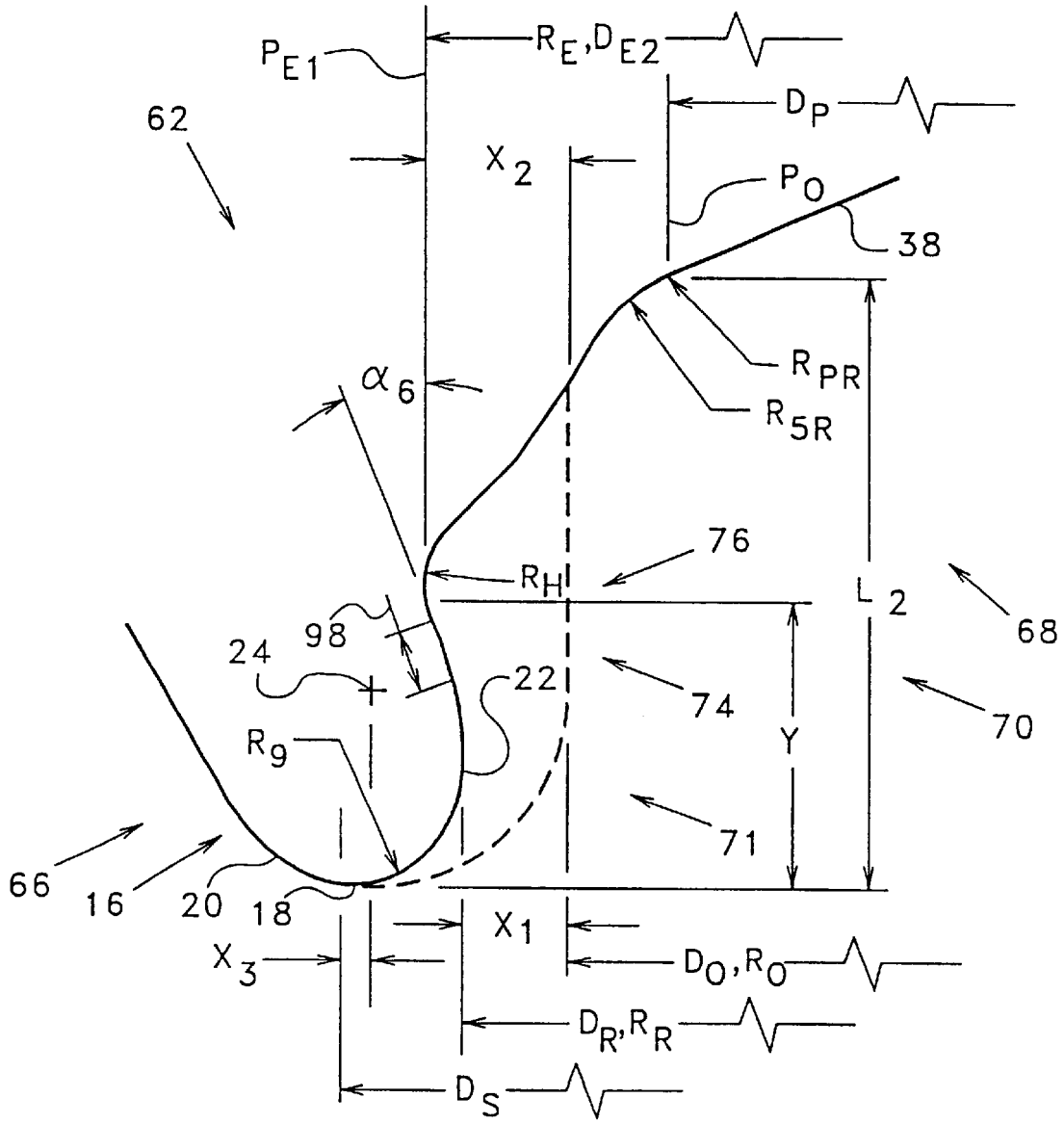
FIG. 15 is a fragmentary and greatly enlarged outline, taken generally as a cross sectional elevation, of the outer contour of the embodiment of FIGS. 10 and 11, taken substantially as shown by section line 15—15 of FIG. 11.
Figure 16:
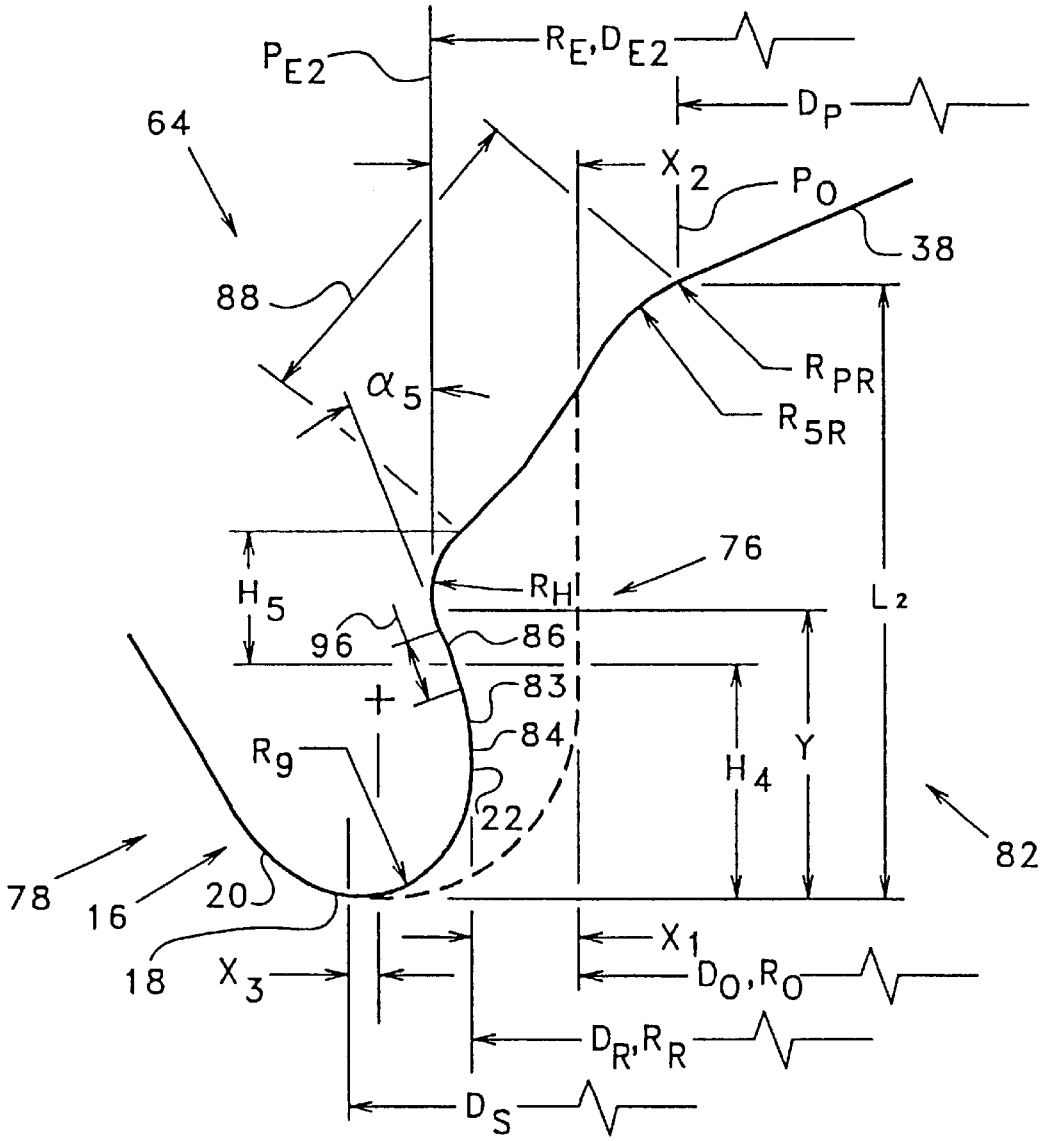
FIG. 16 is a fragmentary and greatly enlarged outline, taken generally as a cross sectional elevation, of the outer contour of the embodiment of FIGS. 12 and 13, taken substantially as shown by section line 16—16 of FIG. 13.

More particularly, containers 10 made generally according to the prior art configuration of FIGS. 3–5 can be reworked into containers 62 of FIGS. 10, 11, 14, and 15, or can be reworked into containers 64 of FIGS. 12, 13 and 16.

Referring now to FIGS. 10, 11, 14, and 15, the container 62 includes a cylindrical sidewall 12 and a bottom 65 having an annular supporting portion 16 with an annular supporting surface 18. The annular supporting surface 18 is disposed circumferentially around the vertical axis 14, and is provided at the circle of revolution 26 where the outer convex annular portion 20 and the inner convex annular portion 22 join.

The bottom 66 includes a bottom recess portion 68 that is disposed radially inwardly of the supporting surface 18 and that includes both the concave domed panel 38 and a dome positioning portion 70.

The dome positioning portion 70 disposes the concave domed panel 38 at the positional distance $L_2$ above the supporting surface 18. The dome positioning portion 70 includes the inner convex annular portion 22, an inner wall 71, and the inner concave annular portion 44.

Referring now to FIGS. 3–5, and more specifically to FIG. 6, before reworking into either the container 62 or the container 64, the container 10 includes a dome positioning portion 54. The dome positioning portion 64 includes the inner convex annular portion 22, the inner wall 42, and the inner concave annular portion 44.

Referring now to FIGS. 14 and 15, fragmentary and enlarged profiles of the outer surface contours of the container 62 of FIGS. 10 and 11 are shown. That is, the inner surface contours of the container 62 are not shown.

The profile of FIG. 14 is taken substantially as shown by section line 14—14 of FIG. 11 and shows the contour of the bottom of the container 62 in the circumferential parts thereof in which the dome positioning portion 70 of the bottom recess portion 68 has not been reworked.

Referring again to FIGS. 10 and 11, the dome positioning portion 70 of the container 62 includes a plurality of first parts 72 that are arcuately disposed around the circumference of the dome positioning portion 70 at a radial distance $R_0$ from the vertical axis 14 as shown in FIG. 11. The radial distance $R_0$ is one half of the inside diameter $D_0$ of FIGS. 14 and 15. The inside diameter $D_0$ occurs at the junction of the inner convex annular portion 22 and the inner wall 71. That is, the inside diameter $D_0$ is defined by the radially inward part of the inner convex annular portion 22.

The dome positioning portion 70 also includes a plurality of circumferentially-spaced adjacent parts 74 that are arcuately disposed around the dome positioning portion 70, that are circumferentially spaced apart, that are disposed at a radial distance $R_1$ from the vertical axis 14 which is greater than the radial distance $R_0$, and that are interposed intermediate of respective ones of the plurality of first parts 72, as shown in FIG. 11. The radial distance $R_R$ of FIG. 11 is equal to the sum of one half of the inside diameter $D_0$ and a radial distance $X_1$ of FIG. 15.

In a preferred configuration of the FIGS. 10 and 11 embodiment, the adjacent parts 74 are 5 in number, each have a full radial displacement for an arcuate angle $\alpha_4$ of 30 degrees, and each have a total length $L_3$ of 0.730 inches.

Referring again to FIG. 14, in circumferential parts of the container 62 of FIGS. 10 and 11 wherein the dome positioning portion 70 is not reworked, the mean diameter $D_3$ of the annular supporting portion 16 is 2.000 inches; and the inside the diameter $D_0$ of the bottom recess portion 68 is 1.9000 inches which is the minimum diameter of the inner convex annular portion 22. A radius $R_7$ of the outer contour of the outer convex annular portion 20 is 0.052 inches; and an outer radius $R_8$ of the inner convex annular portion 22 is 0.052 inches.

It should be noticed that the radii $R_7$ and $R_8$ are to the outside of the container 62 and are therefore larger than the radii $R_1$ and $R_2$ of FIG. 5 by the thickness of the material.

Referring now to FIG. 15, the circumferential parts of the FIGS. 10 and 11 embodiments wherein the dome positioning portion 70 is reworked, a radius $R_9$ of the inner convex annular portion 22 is reduced, the inside diameter $D_0$ is increased by the radial distance $X_1$ to the inside diameter $D_R$, a hooked part 76 of the dome positioning portion 70 is indented, or displaced radially outward, by a radial diameter $X_2$, and the arithmetical mean diameter $D_3$ of the supporting portion 16 is increased by a radial dimension $X_3$ to an arithmetical means diameter $D_S$ of FIG. 15. The hooked part 76 is centered at a distance Y from the supporting surface 18 and includes a radius $R_8$.

Referring now to FIGS. 12, 13, and 16, the container 64 includes the cylindrical sidewall 12 and a bottom 78 having the annular supporting portion 16 with the supporting surface 18. A bottom recess portion 80 of the bottom 78 is disposed radially inwardly of the supporting surface 18 and includes both the concave domed panel 38 and a dome positioning means 82.

The dome positioning portion 82 disposes the concave domed panel 38 at the positional distance $L_2$ above the supporting surface 18 as shown in FIG. 16. The dome positioning portion 82 includes the inner convex annular portion 22, an inner wall 83, and the inner concave annular portion 44 as shown and described in conjunction with FIGS. 3–5.

The dome positioning portion 82 of the container 64 includes a circumferential first part 84 that is disposed around the dome positioning portion 82 at the radial distance $R_R$ from the vertical axis 14 as shown in FIGS. 13 and 16. The radial distance $R_R$ is one half of the diameter $D_0$ of FIG. 16 plus the radial distance $X_1$. The diameter $D_0$ occurs at the junction of the inner convex annular portion 22 and the inner wall 42 of FIG. 6. That is, the diameter $D_0$ is defined by the radially inward part of the inner convex annular portion 22.

The dome positioning portion 82 also includes a circumferential adjacent part 86 that is disposed around the dome positioning portion 82, and that is disposed at an effective radius $R_E$ from the vertical axis 14 which is greater than the radial distance $R_1$ of the first part 84. The effective radius $R_E$ is equal to the sum of one half of the diameter $D_0$ and the radial dimension $X_2$ of FIG. 16. That is, the adjacent part 86 includes the hooked part 76; and the hooked part 76 is displaced from the radial distance $R_0$ by the radial dimension $X_2$. Therefore, it is proper to say that the adjacent part 86 is disposed radially outwardly of the first part 84.

Referring again to FIG. 14, prior to reworking, the mean diameter $D_3$ of the annular supporting portion 16 of the container 64 is 2.000 inches; the inside diameter $D_0$ of the bottom recess portion 68 is 1.900 inches, which is the minimum diameter of the inner convex annular portion 22; and the radii $R_7$ and $R_8$ of the outer and inner convex annular portions, 20 and 22, are 0.052 inches.

Referring now to FIG. 16, the radius $R_9$ of the inner convex annular portion 22 is reduced, the diameter $D_0$ is increased by the radial distance $X_1$ to the diameter $D_R$, a hook part 76 of the dome positioning portion 82 is indented, or displaced radially outward, by the radial dimension $X_2$, and the arithmetical mean diameter $D_3$ of both the supporting portion 16 and the supporting surface 18 of FIG. 14 are increased by the radial dimension $X_3$ to the diameter $D_5$ of FIG. 16. The hook part 76 is centered at the distance Y from the supporting surface 18 and includes the radius $R_B$.

Figure 17:
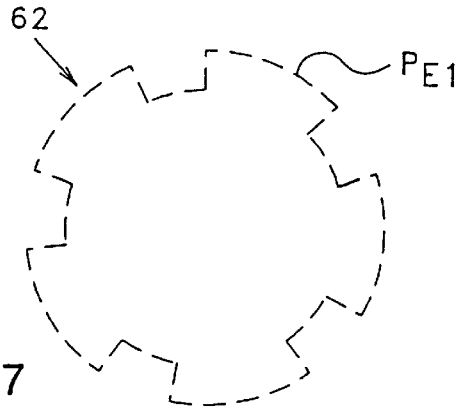
FIG. 17 is a fragmentary top view of the container of FIGS. 10, 11, 14, and 15, taken substantially as shown by view line 17—17 of FIG. 10, and showing the effectively increased perimeter of the embodiment of FIGS. 10 and 11.
Figure 18:
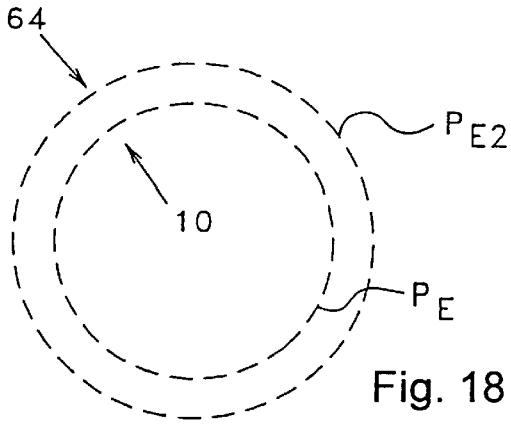
FIG. 18 is a fragmentary to view of the container of FIGS. 12, 13, and 16, taken substantially as shown by view line 18—18 of FIG. 12, and showing both the perimeter of the concave domed panel of the container of FIG. 5 and the effectively increased perimeter of the embodiment of FIGS. 12 and 13.

Referring not to FIGS. 5, 17, and 18, the concave domed panel 38 of the container 10 of FIG. 5 includes the perimeter $P_0$ and an unreworked effective perimeter $P_g$ that includes the inner concave annular portion 44. However, when the container 10 is reworked into the container 62 of FIGS. 10 and 11, the domed panel 36 includes a reworked effective perimeter $P_{E1}$ which is larger than the perimeter $P_E$. In like manner, when the container 10 of FIG. 6 is reworked into the container 64 of FIGS. 12 and 13, the domed panel 18 includes a reworked effective perimeter $P_{E2}$ which is also larger than the unreworked effective perimeter $P_E$.

For testing, containers 10 made according to two different sets of dimensions, and conforming generally to the configuration of FIGS. 3–5, have been reworked into both containers 62 and 64.

More particularly, before reworking, containers 10 were made according to the dimensions of B6A containers, and other containers 10 were made according to the dimensions of Tampa containers. The B6A and the Tampa containers include many dimensions that are the same.

Referring now to FIGS. 4, 5 and 14, prior to reworking, both the B6A containers and the Tampa containers included the following dimensions: $D_1$=2.598 inches; $D_2$, $D_3$=2.000 inches; $D_5$=2.509 inches; $R_3$=0.200 inches; $R_6$= 0.050 inches; $R_6$=0.200 inches; $R_7$ and $R_8$=0.052; $H_3$=0.370 inches; $H_3$=0.008 inches; and $\alpha_2$=00 degrees. Other dimensions, including $R_4$, $H_1$, and the metal thickness are specified in Table 13.

As noted previously, there is a difference between the radius $R_4$ which is produced in a container 10, and the radius $R_T$ of the domer tooling. More particularly, tooling with a radius $R_T$ of 2.12 inches produces a container 10 with a radius $R_4$ of approximately 2.38 inches.

Referring now to FIG. 14, the dome radius $R_4$ will have an actual dome radius $R_C$ proximal to the vertical axis 14, and a different actual dome radius $R_P$ at the perimeter $P_0$. Also, the radii $R_0$ and $R_P$ will vary in accordance with variations of other parameters, such as the height $L_1$ of the inner wall 71. Further, the dome radius $R_4$ will vary at various distances between the vertical axis 14 and the perimeter $P_0$.

The dome radius $R_0$ will be somewhat smaller than the dome radius $R_P$, because the perimeter $P_0$ of the concave domed panel 38 will spring outwardly. However, in the charts, the dome radius $R_4$ is given, and at the vertical axis 14, the dome radius $R_4$ is close to being equal to the actual dome radius $R_0$.

When the containers 10 are reworked into the containers 62 and 64, as shown in FIGS. 6 and 8, the dome radii $R_C$ and $R_P$, as shown in FIG. 4, may or may not change slightly with containers 10 made to various parameters and reworked to various parameters. Changed radii, due to reworking of the dome positioning portions, 70 and 82, are designated actual dome radius $R_{CR}$ and actual dome radius $P_{PR}$ for radii near the vertical axis 14 and near the perimeter $P_0$, respectively. However, since the difference between the dome radii $R_C$ and $R_P$ is small, and since the dome radii $R_C$ and $R_P$ change only slightly during reworking, if at all, only the radius $R_4$ of FIG. 4 is used in the accompanying charts and in the following description.

Reworking of the dome positioning portions, 70 and 82, results in an increase in the radius $R_5$ of FIG. 5. To show this change in radius, the radius $R_5$, after reworking, is designated radius of curvature $R_{5R}$ in FIGS. 15 and 16 and in Table 13. This change in the radius $R_5$ can be rather minimal, or quite large, depending upon various parameters in the original container 10 and/or in reworking parameters.

When the change in the radius $R_5$ of FIG. 5 is quite large, as shown for the Tampa container removed into the container 64, reworking of the container 10 into the container 64 extends an effective diameter $D_8$ of the center panel 38, which includes the concave annular portion 44, and which is shown in FIG. 14, to an effective diameter $D_{12}$, as shown in FIG. 16.

Therefore, in the reworking process, an annular portion 88 of the dome positioning portion 82, as shown in FIG. 16, is moved into, and affectively becomes a part of, the center panel 38.

Further, especially in the process in which the reworking is circumferential, as shown in FIGS. 12, 13, and 16, an annular portion 90, as shown in FIG. 14, of the bottom 78 which lies outside of the annular supporting surface 18, is moved radially inward, and effectively becomes a part of the dome positioning portion 82 of FIG. 16.

In Table 13, the static dome reversal pressure (S.D.R.) is in pounds per square inch, the cumulative drop height (C.D.H.) is in inches, and the internal pressure (I.P.) at which the cumulative drop height tests were run is in pounds per square inch.

A control was run on both B6A and Tampa containers prior to reworking into the containers 62 and 64. In this control testing, the B6A container had a static dome reversal pressure of 97 psi and the Tampa container had a static dome reversal pressure of 95 psi. Further, the B6A container had a cumulative drop height resistance of 9 inches and the Tampa container had a cumulative drop height resistance of 33 inches.

TABLE 13

| | CONTAINER 62 INTERRUPTED ANNULAR INDENT | | CONTAINER 64 CONTINUOUS ANNULAR INDENT | |
|---|---|---|---|---|
| | B6A | TAMPA | B6A | TAMPA |
| $R_4$ | 2.38 | 2.038 | 2.38 | 2.038 |
| $R_T$ | 2.12 | 1.85 | 2.12 | 1.85 |
| $R_{SR}$ | — | — | 0.08 | 0.445 |
| $H_1$ | .385 | .415 | .385 | .415 |
| $D_R$ | 1.950 | 1.950 | 2.000 | 1.984 |
| $D_5$ | 2.020 | 2.020 | 2.051 | 2.041 |
| $R_H$ | .030 | .030 | .050 | .050 |
| $R_9$ | .030 | .030 | .026 | .026 |
| $X_1$ | .025 | .025 | .050 | .042 |
| $X_2$ | .054 | .051 | .055 | .055 |
| $X_3$ | .010 | .010 | .026 | .021 |
| Y | .084 | .086 | .076 | .092 |
| thkns. | .0116 | .0118 | .0116 | .0118 |
| I.P. | 58 | 59 | 58 | 59 |
| S.P.R. | 111 | 120 | 121 | 126 |
| C.D.H. | 10.8 | 30.0 | 18.0 | 60.0 |

Referring now to Table 13, when B6A containers were reworked into the containers 62, which have a plurality of circumferentially-spaced adjacent parts 74 that are displaced radially outwardly, the static dome reversal pressure increased from 97 psi to 111 psi, and the cumulative drop height resistance increased from 9 inches to 10.8 inches.

When the Tampa containers were reworked into the containers 62, the static dome reversal pressure increased from 95 psi to 120 psi, and the cumulative drop height resistance decreased from 33 inches to 30 inches.

When the B6A containers were reworked into the containers 64, which have a circumferential adjacent part 86 that is displaced radially outwardly from a circumferential first part 84, the static dome reversal pressure increased from 97 psi to 121 psi, and the cumulative drop height resistance increased from 9 inches to 18 inches.

Finally, when the Tampa containers were reworked into the containers 64, the static dome reversal pressure increased from 95 psi to 126 psi, and the cumulative drop height resistance increased from 33 inches to 60 inches.

Thus, B6A and Tampa containers reworked into containers 62 of FIGS. 10 and 11 showed an improvement in static dome reversal pressure of 14.4 percent and 26.3 percent, respectively. B6A and Tampa containers reworked into containers 62 showed an improvement in cumulative drop height resistance of 20 percent in the case of the B6A container, but showed a decrease of 10 percent in the case of the Tampa container.

Further, B6A and Tampa containers reworked into containers 64 of FIGS. 12 and 13 showed an improvement in static dome reversal pressure of 24.7 percent and 32.6 percent, respectively. B6A and Tampa containers reworked into containers 64 showed an improvement in cumulative drop height resistance of 100 percent in the case of the B6A container, and an increase of 81.8 percent in the case of the Tampa container.

Therefore, the present invention provides phenomenal increase in both static dome reversal pressure and cumulative drop height without increasing the size of the container, without seriously decreasing the fluid volume of the container as would be caused by increasing the height $L_1$ of the inner wall 71 or 83, or by greatly decreasing the dome radius $R_4$ of the concave domed panel 38, and without increasing the thickness of the metal.

While reworking the Tampa containers into the containers 62 did not show an increase in the cumulative drop height resistance, it is believed that this is due to two facts. One fact is that reworking of the containers 10 into the containers 62 and 64 was made without the benefit of adequate tooling. Therefore, the test samples were not in accordance with production quality. Another fact is that reworking the Tampa containers into the containers 64 resulted in a greater radial distance $X_1$ than did the reworking of the Tampa containers into the containers 62.

However, it remains a fact that reworking the B6A containers into the containers 64 did provide substantial increases in both the static dome reversal pressure and the cumulative drop height resistance.

It is believed that with further testing, parameters will be discovered which will provide additional increases in both static dome reversal pressure and cumulative drop height resistance.

Future testing will extend the parameters into containers with smaller values of dome radii $R_4$. In the aforesaid patent application of common assignee, test results on dome radii $R_4$ as small as 1.750 inches were shown; and these decreases in dome radii $R_4$ provided substantial increases in the cumulative drop height resistance, but with an attendant decrease in static dome reversal pressures.

Since the present invention provides a substantial increase in static dome reversal pressure, and with some parameters, a substantial increase in cumulative drop height resistance, it is believed that the present invention, when used with smaller dome radii $R_4$, or with center panel configurations other than spherical radii, will provide even greater combinations of static dome reversal pressures and cumulative drop height resistances than reported herein.

From general engineering knowledge, it is obvious that a dome radius $R_4$ that is too large would reduce the static dome reversal pressure. Further, it has been known that too small a dome radius $R_4$ would also reduce the static dome reversal pressure, even though a smaller dome radius $R_4$ should have increased the static dome reversal pressure.

While it is not known for a certainty, it appears that smaller values of dome radii $R_4$ placed forces on the inner wall 42 that were concentrated more directly downwardly against the inner convex annular portion 22, thereby causing roll-out of the inner convex annular portion 22 and failure of the container 10.

In contrast, a larger dome radius $R_4$ would tend to flatten when pressurized. That is, a dome that was initially flatter would flatten further due to pressure, it would expand radially and place a force radially outward on the top of the inner wall 42, thereby tending to prevent roll-out of the inner convex annular portion 22.

However, a larger dome radius $R_4$ would have insufficient curvature to resist internal pressures, thereby resulting in dome reversal at pressures that are too low to meet beverage producer' requirements.

The present invention, by strengthening the inner wall 42 of the container 10 to the inner wall 71 of the container 62, or by strengthening the inner wall 83 of the container 64, increases the roll-out resistance, as seen by the phenomenal increases in static dome reversal pressures that are achieved. These phenomenal increases in static dome reversal pressures are achieved by decreasing the force which tends to roll-out the inner convex annular portion 22.

More specifically, as seen in FIG. 16, in the instance of the container 64 where the adjacent part 86 of the dome positioning portion 82 is circumferential, an effective diameter $D_Z$ of the concave domed panel 38 is increased. The container 64 also has an effective perimeter $P_2$ as shown in FIG. 18.

Or, as seen in FIG. 15 which shows circumferentially-spaced adjacent parts 74 that are displaced outwardly, an effective radius $R_Z$ of the domed panel 38 is increased. An increase in the radius $R_Z$ by the circumferentially-spaced adjacent parts 74 increases the effective perimeter $P_1$ of the domed panel 38 as shown in FIG. 17.

It can be seen by inspection of FIGS. 15 and 16 that placing the dome pressure force farther outwardly, as shown by the diameter $D_g$ and the radius $R_Z$, reduces the moment arm of the roll-out force. That is, the ability of a given force to roll-out the inner convex annular portion 22 depends upon the distance, radially inward, where the dome pressure force is applied. Therefore, the increase in the effective diameter $D_g$ of the container 64, and the increase in the effective radius $R_2$, decreases the roll-out forces and thereby increase the resistance to roll-out.

Also, as shown in Table 13, the radius $R_9$ is reduced; and, from the preceding discussion. It can be seen that this reduction in radius also helps the containers 62 and 64 resist roll-out.

Continuing to refer to FIG. 16, the first part 84 of the container 64 is circumferential and might be considered to have a high $H_4$, and the adjacent part 86 is also circumferential and might be considered to have a height $H_5$. That is, defining the heights, $H_4$ and $H_5$, is somewhat arbitrary. However, as can be seen, the adjacent part 86 is disposed radially outward from the first part 84; and the hooked part 76 of the dome positioning portion 82 is formed with the radius $R_H$.

Thus, in effect, after reworking into a container 64, the dome positioning portion 82 is bowed outwardly at the distance Y from the supporting surface 18. This bowing outwardly of the dome positioning portion 82 is believed to provide a part of the phenomenal increase in static dome reversal pressure. That is, as the concave domed panel 38 applies a pressure-caused force downwardly, the outwardly-bowed dome positioning portion 82 tends to buckle outwardly, elastically and/or both elastically and plastically.

As the dome positioning portion 82 tends to buckle outwardly, it places a roll-in force on the inner convex annular portion 22, thereby increasing the roll-out resistance.

That is, whereas the downward force of the concave domed panel 38 presses downwardly tending to unroll both the outer convex annular portion 20 and the inner convex annular portion 22, the elastic and/or elastic and plastic buckling of the dome positioning portion 82 tends to roll up the convex annular portions, 20 and 22.

In like manner, as shown in FIG. 15, in circumferential portions of the container 62 which include the adjacent parts 74 and the hooked parts 76, the tendency of the dome positioning portion 70 to buckle outwardly is similar to that described for the dome positioning portion 82. However, since the hooked part 76 exists only in those circumferential parts of the dome positioning portion 70 wherein the adjacent parts 74 are located, the roll-in effect is not as great as in the container 44.

In summary, as shown and described herein, the present invention provides containers, 62 and 64, in which improvements in roll-out resistance, static dome reversal pressure, and cumulative drop height are all achieved without increasing the metal thickness. Or, conversely, the present invention provides containers, 62 and 64, in which satisfactory values of roll-out resistance, static dome reversal pressure, and cumulative drop height can be achieved using metal of a thinner gauge than has heretofore been possible.

It is believed that the present invention yields unexpected results. Whereas, in prior art designs, a decrease in the dome radius $R_4$ has decreased the dome reversal pressure, in the present invention, a decrease in the dome radius $R_4$, combined with strengthening the dome positioning portion, 70 or 82, achieves a remarkable increase in both dome reversal pressure and cumulative drop height resistance.

Further, the fact that phenomenal increases in both cumulative drop height resistance and static dome reversal pressures have been achieved by simply reworking a container of standard dimensions is believed to constitute unexpected results.

When referring to dome radii $R_4$, or to limits thereof. It should be understood that, while the concave domed panels 38 of containers 62 and 64 have been made with tooling having a spherical radius, both the spring-back of the concave domed panel 38 of the container 10, and reworking of the container 10 into containers 62 and 64, change the dome radius from a true spherical radius.

Therefore, in the claims, a specified radius, or a range of radii for the radius. $R_4$ would apply to either a central portion 92 or to an annular portion 94, both of FIGS. 10 and 12.

The central portion 92 has a diameter $D_{CP}$ which may be any percentage of the diameter $D_P$ of the concave domed panel 38; and the annular portion 94 may be disposed at any distance from the vertical axis 14 and may have a radial width $X_4$ of any percentage of the diameter $D_P$ of the concave domed panel 38.

Further, while the preceding discussion has focused on concave domed panels 38 with radii $R_4$ that are generally spherical, or concave domed panels made with spherical tooling, the present invention is applicable to containers, 62 or 64, in which the concave domed panels 38 are ellipsoidal, decrease in radius of curvature as a function of the distance radially outward of the concave domed panel 38 from the vertical axis 14, or have some portion, 92 or 94, that is substantially spherical.

While the limits pertaining to the shape of the center panel 38 may be defined as functions of dome radii $R_4$, limits pertaining to the shape of the center panel 38 can be defined as limits for the central portion 92 or for the annular portion 94 of the center panel 38, or as limits for the angle $\alpha_3$, whether at the perimeter $P_0$, or at any other radial distance from the vertical axis 14.

Referring finally to FIGS. 5, and 10–16: another distinctive difference in the present invention is in the slope of the inner walls, 71 and 83, of containers 62 and 64, respectively. As seen in FIG. 5, the inner wall 42 of the prior art slopes upwardly and inwardly by the angle $\alpha_1$.

In stark contrast to the prior art, the inner wall 83 of the container 64 of FIGS. 12, 13, and 16 include a negatively-sloping part 96 that slopes upwardly and outwardly at a negative angle $\alpha_5$. As seen in FIG. 13, the negatively-sloping part 96 extends circumferentially around the vertical axis 14.

Also in stark contrast to the prior art, the inner wall 71 of the container 62 of FIGS. 10, 11 and 15 includes a negatively-sloping part 98 that slopes upwardly and outwardly by a negatively angle $\alpha_6$, and that is disposed arcuately around less than one-half of the bottom 66 of the container 62. The inner wall 71 also includes another negatively-sloping part 100 that slopes upwardly and outwardly at the negative angle $\alpha_6$, and that is spaced circumferentially from the negatively-sloping part 98.

In summary, the present invention provides these remarkable and unexpected improvements by means and method as recited in the aspects of the invention which are included herein.

Although aluminum containers have been investigated, it is believed that the same principles, namely increasing the curvature of the concave domed panel 38 and/or increasing the angle $\alpha_3$, and increasing the roll-out resistance of the inner wall, from the inner wall 42 of the container 10 to either the inner wall 71 of container 62 or the inner wall 83 of the container 64, would be effective to increase the strength of containers made from other materials, including ferrous and nonferrous metals, plastic and other nonmetallic materials.

Figure 2:
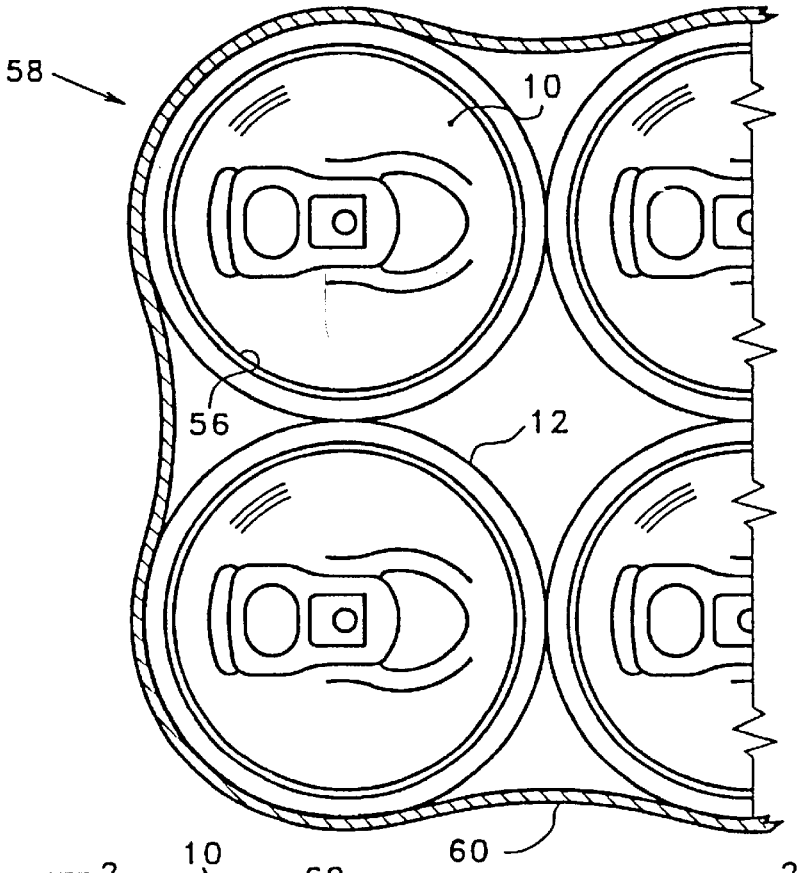
FIG. 2 is a top view of the bundled beverage containers of FIG. 1 taken substantially as shown by view line 2—2 of FIG. 1.
Figure 1:
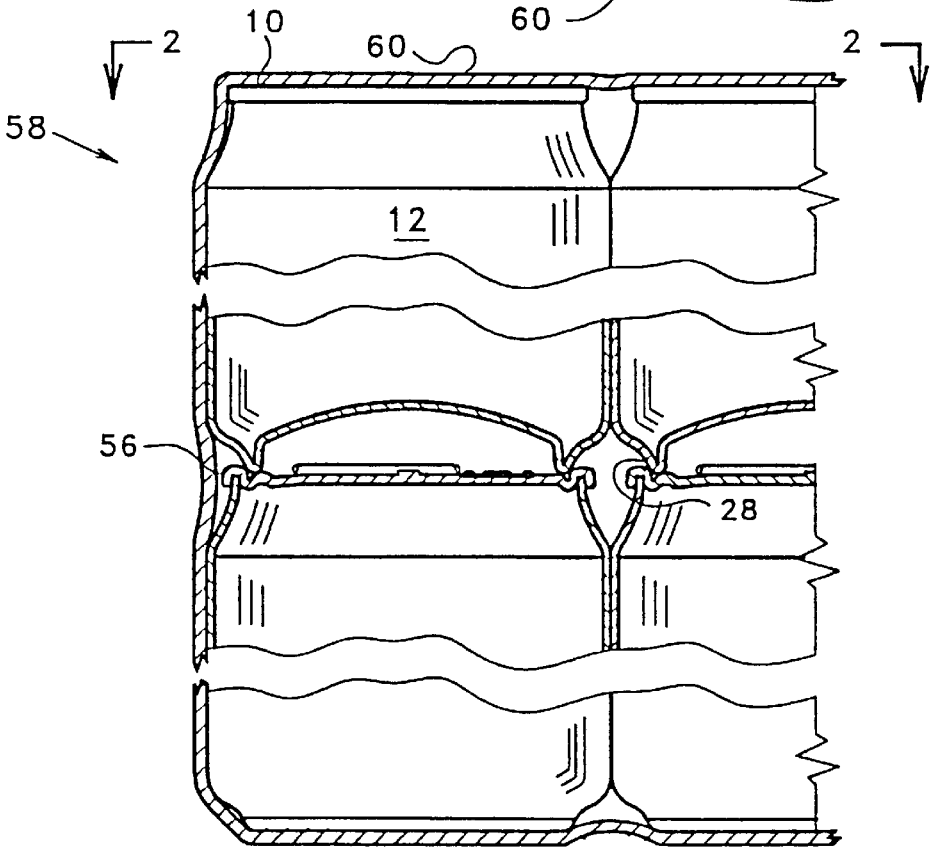
FIG. 1 is a front elevation of beverage containers that are bundled by shrink wrapping with plastic film.

Referring finally to FIGS. 1 and 2, upper ones of the containers 10 stack onto lower ones of the containers 10 with the outer connecting portions 28 of the upper ones of the containers 10 nested inside double-seamed tops 56 of lower ones of the containers 10; and both adjacent disposed and vertically stacked containers 10 are bundled into a package 58 by the use of a shrink-wrap plastic 60.

While this method of packaging is more economical than the previous method of boxing, possible damage due to rough handling becomes a problem, so that the requirements for cumulative drop resistances of the containers 10 is more stringent. It is this problem that the present invention addresses and solves.

While specific methods and apparatus have been disclosed in the preceding description. It should be understood that these specifics have been given for the purpose of disclosing the principles of the present invention and that many variations thereof will become apparent to those who are versed in the art. Therefore, the scope of the present invention is to be determined by the appended claims.

Industrial Applicability

The present invention is applicable to containers made of aluminum and various other materials. More particularly, the present invention is applicable to beverage containers of the type having a seamless, drawn and ironed, cylindrically-shaped body, and an integral bottom with an annular supporting portion.

What is claimed is:

1. A container with improved strength, said container having an internal containment space, which comprises:

a container wall disposed around a vertical axis;

a bottom attached to said container wall, having a supporting surface, a sidewall connecting said container wall to said supporting surface, a center panel, the major portion of which is disposed radially inwardly of said supporting surface, and a panel positioning portion connecting said supporting surface to said center panel, said panel positioning portion having an upper end and a lower end, said center panel having an upwardly extending outer portion;

wherein said support surface forms a support surface radius interconnecting said support surface to said lower end of said panel positioning portion;

said panel positioning portion comprising:

a first panel positioning part, contiguous with said supporting surface, wherein at least the uppermost portion of said first panel positioning part slopes inwardly and upwardly relative to supporting surface;

a second panel positioning part, interconnected, at its upper edge with said outer portion of said center panel, to define a wall radius between said upper edge of said second panel positioning part and said outer portion of said center panel, and positioned above said first panel positioning part;

said second panel positioning part, interconnected, at its lower edge with said first panel positioning part to define an inter-part radius between said first panel positioning part and said second panel positioning part and wherein said inter-part radius is separate, distinct from and spaced from each of said wall radius and said support surface radius, said inter-part radius being located at a vertical level between said wall radius and said support surface radius; and wherein said outer wall, said sidewall, said first panel positioning part, and said second panel positioning part, substantially define at least a portion of said internal containment space.

2. A container as claimed in claim 1, in which said second panel positioning part of said inner wall is substantially circumferential.

3. A method of forming a can body, said can body having a longitudinal axis, the method comprising:

forming a container having a generally cylindrical outer wall and a bottom attached to said generally cylindrical wall, said bottom including a supporting surface which defines a first diameter, a sidewall connecting said cylindrical wall to said supporting surface, a central panel, the major portion of which is disposed radially inwardly of said supporting surface, and a panel positioning portion having a lower end and an upper end, said panel positioning portion connecting said supporting portion to said central panel wherein said central panel forms a first radius interconnecting said central panel to said upper end of said panel positioning portion and wherein said support surface forms a second radius interconnecting said support surface to said lower end of said panel positioning portion; and reforming said panel positioning portion, after said step of forming, to impart a third radius therein, wherein said third radius is separate, distinct from and spaced from each of said first radius and said second radius, said third radius being located at a vertical level between said first radius and said second radius.

4. A method, as claimed in claim 3, wherein said step of reforming is performed in the absence of reducing the diameter defined by said supporting surface.

5. A method, as claimed in claim 3, wherein said step of reforming is performed in the absence of radially inward movement of said sidewall.

6. A method, as claimed in claim 3, wherein said third radius has a magnitude of about 0.05 inches.

* * * * *